US005238799A

United States Patent [19]

Usami et al.

[11] Patent Number: 5,238,799

[45] Date of Patent: Aug. 24, 1993

[54] SILVER HALIDE PHOTOGRAPHIC MATERIAL

[75] Inventors: Takashi Usami; Shigeru Ohno; Yoko Idogaki, all of Kanagawa, Japan

[73] Assignee: Fuji Photo Film Co., Ltd., Kanagawa, Japan

[21] Appl. No.: 946,166

[22] Filed: Sep. 17, 1992

Related U.S. Application Data

[63] Continuation-in-part of Ser. No. 709,569, Jun. 3, 1991, abandoned.

[30] Foreign Application Priority Data

Jun. 4, 1990 [JP] Japan ..... 2-145835
Nov. 8, 1990 [JP] Japan ..... 2-303170

[51] Int. Cl.[5] ..... G03C 1/06

[52] U.S. Cl. ..... 430/522; 430/510; 430/512; 430/517

[58] Field of Search ..... 430/522, 963, 510, 512, 430/513, 517, 595, 520, 521

[56] References Cited

U.S. PATENT DOCUMENTS

| | | | |
|---|---|---|---|
| 3,502,474 | 3/1970 | Tsuda et al. . | |
| 4,092,168 | 5/1978 | Lemanhieu et al. . | |
| 4,895,786 | 1/1990 | Kurematsu et al. | 430/522 |
| 4,940,654 | 2/1990 | Diehl et al. | 430/522 |
| 4,960,686 | 10/1990 | Kawashima et al. | 430/522 |
| 4,994,356 | 2/1981 | Diehl et al. | 430/522 |
| 4,996,138 | 2/1991 | Murai et al. | 430/522 |

FOREIGN PATENT DOCUMENTS

| | | |
|---|---|---|
| 0015601 | 9/1980 | European Pat. Off. . |
| 1338799 | 11/1973 | United Kingdom . |

*Primary Examiner*—Jack P. Brammer
*Attorney, Agent, or Firm*—Sughrue, Mion, Zinn, Macpeak & Seas

[57] ABSTRACT

Disclosed is a silver halide photographic material having a hydrophilic colloid layer which contains a dispersion of fine solid grains of at least one dye of formula (I):

(I)

where $R_1$ and $R_2$ each represents an alkyl group, an aryl group, a cyano group or a group of $COOR_3$, $COR_3$, $CONR_4R_5$, $NR_4R_5$, $NR_4COR_3$, $NR_4CONR_4R_5$, $OR_3$, $SR_3$, $SOR_3$ or $SO_2R_3$; $R_3$ being an alkyl group or an aryl group, and $R_4$ and $R_5$ each being a hydrogen atom, an alkyl group or an aryl group, and $R_3$ and $R_4$ or $R_4$ and $R_5$ being optionally bonded to each other to form a 5-membered or 6-membered ring; $L_1$, $L_2$ and $L_3$ each represents a methine group; and n represents 0 or 1; provided that $R_1$, $R_2$, $L_1$, $L_2$ and $L_3$ must not have an ionizable proton-having group or a salt thereof. The material preferably has, in addition to the dispersion of fine solid grains of at least one dye of formula (I), a dispersion of fine solid grains of at least one dye of formula (II):

(II)

where $R_{21}$ and $R_{23}$ each represents a hydrogen atom, an alkyl group or an aryl group; $R_{22}$ and $R_{24}$ each represents an alkyl group, an aryl group, or a group of $OR_{26}$, $COOR_{26}$, $COR_{25}$, $SR_{26}$, $SOR_{25}$, $SO_2R_{25}$, $CONR_{26}R_{27}$, $NR_{26}COR_{25}$, $NR_{26}CONR_{26}R_{27}$ or $NR_{25}R_{26}$, or a cyano group; $R_{25}$ being an alkyl group or an aryl group, and $R_{26}$ and $R_{27}$ each being a hydrogen atom, an alkyl group or an aryl group, and $R_{25}$ and $R_{26}$or $R_{26}$and $R_{27}$ being optionally bonded to each other to form a 5-membered or 6-membered ring; and $L_{21}$, $L_{22}$ and $L_{23}$ each represents a methine group; provided that the formula has at least one aryl group having at least one substituent selected from the group consisting of a carboxylic acid (Abstract continued on next page.)

group, a sulfonamide group and an arylsulfamoyl group except for the case where $R_{21}$ and $R_{23}$ are both hydrogen atoms. The dyes (I) and (II) color only a hydrophilic colloid layer containing them, and they do not diffuse to any other layers during storage of the material. After developed, the dyes (I) and (II) are rapidly decolored.

11 Claims, 1 Drawing Sheet

SILVER HALIDE PHOTOGRAPHIC MATERIAL

This is a continuation-in-part of application Ser. No. 07/709,569, filed Jun. 3, 1991, now abandoned.

FIELD OF THE INVENTION

The present invention relates to a silver halide photographic material having a colored hydrophilic colloid layer and, more precisely, it relates to a silver halide photographic material having a hydrophilic colloid layer containing (a) dye(s) which is/are photochemically inactive and is/are easily decolored and/or dissolved out in the step of photographic processing.

BACKGROUND OF THE INVENTION

In preparing silver halide photographic materials, coloration of photographic emulsion layers and other hydrophilic colloid layers is often effected for the purpose of absorbing lights falling within a particular wavelength range.

If it is necessary to control the spectral composition of the light to penetrate into photographic emulsion layers, a colored layer is provided on the support more remotely from the support than photographic emulsion layers. The colored layer is called a filter layer. In the case of a multi-layered color photographic material having plural photographic emulsion layers, the filter layer may be positioned in the intermediate between them.

For the purpose of preventing blur of images to be caused by re-penetration of the light as once scattered during or after passing through photographic emulsion layers and reflected on the interface between the emulsion layer and the support or on the surface of the photographic material opposite to the emulsion layer, into the photographic emulsion layers, or for the purpose of preventing such halation, a colored layer may be provided between the photographic emulsion layer and the support or on the surface of the support opposite to the photographic emulsion layer. The colored layer is called an anti-halation layer. In the case of a multilayered color photographic material having plural photographic emulsion layers, the anti-halation layer may be provided in the intermediate between the respective layers.

For the purpose of preventing lowering of the image sharpness to be caused by scattering of light in photographic emulsion layers (the phenomenon is generally called "irradiation"), coloration of photographic emulsion layers is often effected.

The layers to be colored for the purpose are hydrophilic colloid layers and, in general, dyes are incorporated into the layers so as to color them. The dyes need to satisfy the following conditions.

(1) They have a pertinent spectral absorption in accordance with the use and the object.

(2) They are photochemically inactive. That is to say, they do not have any harmful influences on the chemical properties of silver halide photographic emulsion layers. For example, they do not lower the sensitivity of the emulsion layers, they do not cause latent image fading and they do not cause fogging.

(3) They are decolored or dissolved out in the step of photographic processing or rinsing so that they do not leave any harmful coloration on the processed photographic materials.

(4) They do not diffuse from the layer as dyed with them to any other layers.

(5) They have an excellent time-dependent storage stability in solutions or in photographic materials and are neither discolored nor faded during storage.

In particular, where the colored layer is a filter layer or it is an anti-halation layer to be positioned on the same surface of the support as that having photographic emulsion layers, it is often necessary that such a filter layer or anti-halation layer only is selectively colored in such a way that coloration of the layer does not substantially extend to any other layers. This is because, if not, not only the colored filter layer or anti-halation layer would have any harmful spectral effect on other layers but also the effect of the intended filter layer or anti-halation layer would be lowered. However, when the dye-added layer is brought into contact with any other hydrophilic colloid layers while they are still wet, a part of the dye in the former layer would often diffuse to the latter layers. In order to prevent such diffusion of dyes, various efforts have hitherto been made.

For instance, a method of incorporating a hydrophilic polymer as charged oppositely to the dissociated anionic dye into a layer as a mordant agent along with the dye so that the dye is localized to a particular layer because of the interaction between the polymer and dye molecule is illustrated in U.S. Pat. Nos. 2,548,564, 4,124,386 and 3,625,694.

A method of dyeing a particular layer with dye-adsorbed fine metal salt grains is illustrated in U.S. Pat. Nos. 2,719,088, 2,496,841 and 2,496,843 and JP-A-60-45237 (the term "JP-A" as used herein means an "unexamined published Japanese patent application").

A method of dyeing a particular layer with a water-insoluble dye solid is illustrated in JP-A-55-120030, JP-A-56 12639, JP-A-55-155350, JP-A-55-155351, JP A-63-27838, JP-A-63-197943 and JP-A-52-92716, European Patents 15601, 276566, 274723, 323729 and 299435 and PCT 88/04794.

However, even though such improved methods are employed, there are still various problems. Precisely, dyes are often diffused in the dye-fixed layer; the decoloring speed during development is often low; and where the conditions of processing photographic materials are changed, for example, by employing rapid processing system, employing modified processing solution compositions or employing modified photographic emulsion compositions, the decoloring mechanism could not always sufficiently be displayed.

SUMMARY OF THE INVENTION

Accordingly, the object of the present invention is to provide a photographic material which contains (a) dye(s) in the form of a dispersion of fine solid grains thereof, the dye(s) being so planned that it/they colors/color only a defined hydrophilic colloid layer, that it/they does/do not diffuse to any other layers during storage and that it/they is/are rapidly decolored during development.

The object of the present invention can be attained by a silver halide photographic material having a hydrophilic colloid layer which contains a dispersion of fine solid grains of at least one dye of a general formula (I):

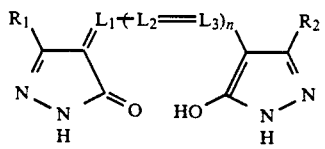

(I)

where $R_1$ and $R_2$ each represents an alkyl group, an aryl group, a cyano group or a group of $COOR_3$, $COR_3$, $CONR_4R_5$, $NR_4R_5$, $NR_4COR_3$, $NR_4CONR_4R_5$, $OR_3$, $SR_3$, $SOR_3$ or $SO_2R_3$; $R_3$ being an alkyl group or an aryl group, and $R_4$ and $R_5$ each being a hydrogen atom, an alkyl group or an aryl group, and $R_3$ and $R_4$ or $R_4$ and $R_5$ being optionally bonded to each other to form a 5-membered or 6-membered ring; $L_1$, $L_2$ and $L_3$ each represents a methine group; and n represents 0 or 1; provided that $R_1$, $R_2$, $L_1$, $L_2$ and $L_3$ must not have an ionizable proton-having group or a salt thereof.

The object of the present invention can also be attained by a silver halide photographic material having a hydrophilic colloid layer which contains a dispersion of fine solid grains of at least one dye of the above-mentioned formula (I) and having a hydrophilic colloid layer which contains a dispersion of fine solid grains of at least one dye of a general formula (II):

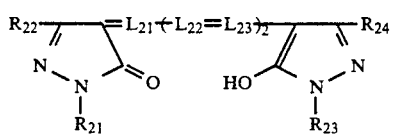

(II)

where $R_{21}$ and $R_{23}$ each represents a hydrogen atom, an alkyl group or an aryl group; $R_{22}$ and $R_{24}$ each represents an alkyl group, an aryl group, or a group of $OR_{26}$, $COOR_{26}$, $COR_{25}$, $SR_{26}$, $SOR_{25}$, $SO_2R_{25}$, $CONR_{26}R_{27}$, $NR_{26}COR_{25}$, $NR_{26}CONR_{26}R_{27}$ or $NR_{25}R_{26}$, or a cyano group; $R_{25}$ being an alkyl group or an aryl group, and $R_{26}$ and $R_{27}$ each being a hydrogen atom, an alkyl group or an aryl group, and $R_{25}$ and $R_{26}$ or $R_{26}$ and $R_{27}$ being optionally bonded to each other to form a 5-membered or 6-membered ring; and $L_{21}$, $L_{22}$ and $L_{23}$ each represents a methine group; provided that the formula has at least one aryl group having at least one substituent selected from the group consisting of a carboxylic acid group, a sulfonamide group and an arylsulfamoyl group except for the case where $R_{21}$ and $R_{23}$ are both hydrogen atoms.

DETAILED DESCRIPTION OF THE INVENTION

Figures 1A, 1B, 1C, 1D, 1E:
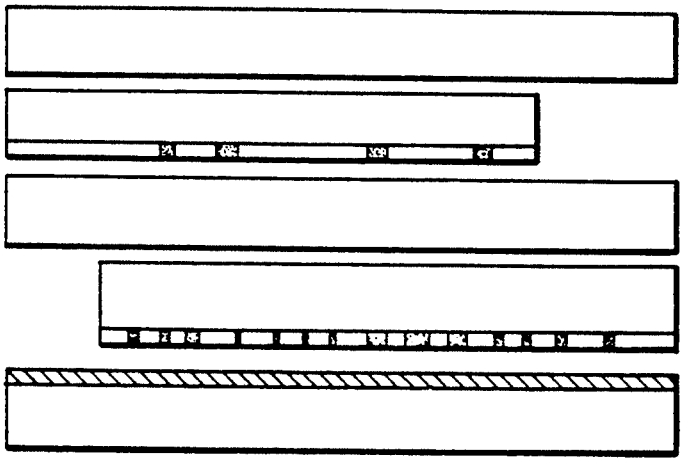
FIG. 1 shows one constitutional embodiment during exposure in case of formation of super-imposed letter images by overlay contact work, where (a) is a transparent or semitransparent support, (b) is a line original in which the black portions indicate line works, (c) is a transparent or semitransparent support, (d) is a halftone original in which the black portions indicate dot images, and (e) is a dot-to-dot working photographic material in which the shadow portion indicates a light-sensitive layer.

Dyes of formula (I) will be explained in detail hereunder.

The alkyl group to be represented by $R_1$, $R_2$, $R_3$, $R_4$ or $R_5$ is preferably one having from 1 to 8 carbon atoms (for example, methyl, ethyl, n-propyl, isopropyl, n-butyl, sec-butyl, t-butyl, isobutyl, n-pentyl, n-hexyl, n-heptyl, n-octyl, cyclohexyl, 2-ethylhexyl, 3-methylbutyl, cyclopentyl, 2-ethylbutyl). It may optionally have substituent(s) selected from, for example, a halogen atom (e.g., F, Cl, Br), a cyano group, a nitro group, a hydroxyl group, an amino group having up to 6 carbon atoms (e.g., unsubstituted amino, dimethylamino, diethylamino), an alkoxy group having from 1 to 8 carbon atoms (e.g., methoxy, ethoxy), an aryloxy group having from 6 to 10 carbon atoms (e.g., phenoxy, p-methylphenoxy), an aryl group having from 6 to 10 carbon atoms (e.g., phenyl, 2-chlorophenyl), and an ester group having from 2 to 8 carbon atoms (e.g., methoxycarbonyl, ethoxycarbonyl).

The aryl group to be represented by $R_1$, $R_2$, $R_3$, $R_4$ or $R_5$ is preferably one having from 6 to 10 carbon atoms, for example, a phenyl group or a naphthyl group. More preferably, it is a phenyl group. It may optionally have substituent(s) selected from for example, those mentioned above as examples of substituents to be on the alkyl group and additionally an alkyl group having from 1 to 4 carbon atoms (e.g., methyl, ethyl, t-butyl, n-propyl).

As examples of the 5-membered or 6-membered ring to be formed by $R_3$ and $R_4$, there are mentioned a pyrrolidone ring and a 2-oxypiperidine ring. As examples of the 5-membered or 6-membered ring to be formed by $R_4$ and $R_5$, there are mentioned a pyrrolidine ring, a piperidine ring and a morpholine ring.

As one characteristic feature of the present invention, $R_1$ and $R_2$ must not have an ionizable proton-having group or a salt thereof (for example, inorganic salts such as Na, K or Li salt; and organic amine salts such as triethylamine or pyridine sale). As examples of ionizable proton-having groups, there are mentioned a sulfonic acid group, a carboxylic acid group, a phosphoric acid group and a sulfonamido group.

The methine group to be represented by $L_1$, $L_2$ or $L_3$ may be either substituted or unsubstituted. As substituents, there are mentioned, for example, methyl, ethyl, benzyl and phenyl group and chlorine atom.

Specific examples of dyes of formula (I) usable in the present invention are mentioned below, with respect to the groups of constituting them. However, these are not limitative.

| No. | $R_1$ | $R_2$ | $=L_1(L_2=L_3)_n-$ |
|---|---|---|---|
| I-1 | $-CH_3$ | $-CH_3$ | $=CH-$ |
| I-2 | $-C_3H_7(n)$ | $-C_3H_7(n)$ | $=CH-$ |
| I-3 | $-C_4H_9(n)$ | $-C_4H_9(n)$ | $=CH-$ |
| I-4 | $-C_5H_{11}(n)$ | $-C_5H_{11}(n)$ | $=CH-$ |
| I-5 | $-COOC_3H_7(n)$ | $-COOC_3H_7(n)$ | $=CH-$ |
| I-6 | $-OC_4H_9(n)$ | $-OC_4H_9(n)$ | $=CH-$ |
| I-7 | $-C_4H_9(t)$ | $-C_4H_9(t)$ | $=CH-$ |
| I-8 | $-COOCH_3$ | $-COOCH_3$ | $=CH-$ |
| I-9 | $-CONHC_4H_9(n)$ | $-CONHC_4H_9(n)$ | $=CH-$ |

-continued

| No. | $R_1$ | $R_2$ | $=L_1\rightleftharpoons L_2=L_3\rightleftharpoons_n$ |
|---|---|---|---|
| I-10 | 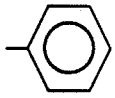 | 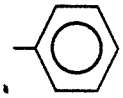 | =CH— |
| I-11 | —$CH_2$— 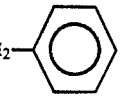 | —$CH_2$— 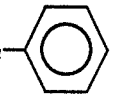 | =CH— |
| I-12 | —$N(CH_3)_2$ | —$N(CH_3)_2$ | =CH— |
| I-13 | —$NHCOCH_3$ | —$NHCOCH_3$ | =CH— |
| I-14 | $CH_3CO$— | $CH_3CO$— | =CH— |
| I-15 | $^nC_4H_9CO$— | $^nC_4H_9CO$— | =CH— |
| I-16 | 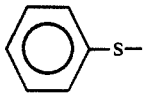 | 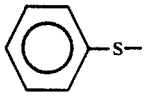 | =CH— |
| I-17 | 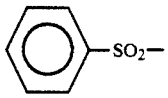 | 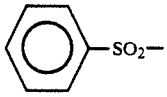 | =CH— |
| I-18 | —$NHCONHC_2H_5$ | —$NHCONHC_2H_5$ | =CH— |
| I-19 | —CN | —CN | =CH— |
| I-20 | —SO— 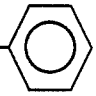 | —SO— 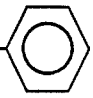 | =CH— |
| I-21 | —$CONHC_6H_{13}$(n) | —$CONHC_6H_{13}$(n) | =CH— |
| I-22 | —$NHCOC_5H_{11}$(i) | —$NHCOC_5H_{11}$(i) | =CH— |
| I-23 | —CONH— 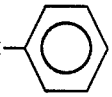 | —CONH— 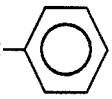 | =CH— |
| I-24 | —$C_4H_9$(t) | —$C_4H_9$(t) | =CH—CH=CH— |
| I-25 | —$NHCOC_6H_{11}$(n) | —$NHCOC_6H_{11}$(n) | =CH—CH=CH— |
| I-26 | —$OC_3H_7$(n) | —$OC_3H_7$(n) | =CH—CH=CH— |
| I-27 | —$C_3H_7$(n) | —$C_3H_7$(n) | =CH—C($CH_3$)=CH— |
| I-28 | —$CONHC_5H_{11}$(n) | —$CONHC_5H_{11}$(n) | =CH—C($CH_3$)=CH— |
| I-29 | —$NHCH_3$ | —$NHCH_3$ | =CH—CH=CH— |
| I-30 | —CO— 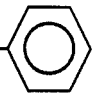 | —CO— 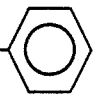 | =CH—CH=CH— |
| I-31 | —$CONHC_4H_9$(n) | —$CONHC_4H_9$(n) | =CH—CH=CH— |
| I-32 | 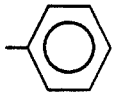 | 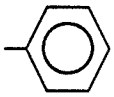 | =CH—CH=CH— |
| I-33 | —$C_4H_9$(n) | —$CH_3$ | =CH— |
| I-34 | —$CONHC_3H_7$(n) | —$C_4H_9$(n) | =CH—CH=CH— |

-continued

| No. | $R_1$ | $R_2$ | $=L_1\leftarrow L_2=L_3\rightarrow_n$ |
|---|---|---|---|
| I-35 | $-C_3H_7(n)$ | $-C_3H_7(n)$ | $=\overset{CH_3}{\overset{\vert}{C}}-CH=CH-$ |

Dyes of formula (I) are produced by known methods, for example, in accordance with the methods described in JP-A-52-92716 and JP-A-64-40827 or with the methods mentioned below.

PRODUCTION EXAMPLE 1 (Production of I-1)

A mixture comprising 9.8 g of 3-methylpyrazolin-5-one, 50 ml of pyridine and 14.8 g of ethyl orthoformate was heated on a steam bath for 3 hours with stirring, whereupon the internal temperature in the reaction system was 80° to 85° C. The reaction mixture was cooled to room temperature and poured into 200 ml of ice-water. A concentrated hydrochloric acid was added thereto, so that the resulting reaction mixture had a pH value of about 3. The crystal thus precipitated out was taken out by filtration and fully washed with water and dried. As a result, 8.7 g of (I-1) was obtained.

$\lambda_{max}=411$ nm; $\epsilon_{max}=1.39\times10^4$ (in methanol)

PRODUCTION EXAMPLE 2 (Production of I-3)

The same process as in Production Example 1 was repeated except that 14 g of 3-butylpyrazolin-5-one was used in place of 3-methylpyrazolin-5-one. As a result, 11.2 g of (I-3) was obtained.

$\lambda_{max}=416$ nm; $\epsilon_{max}=1.40\times10^4$ (in dimethyl formamide)

PRODUCTION EXAMPLE 3 (Production of I-9)

A mixture comprising 8.8 g of 3-butylcarbamoylpyrazolin-5-one, 90 ml of acetic acid and 8.9 g of ethyl orthoformate was heated on a steam bath for 3 hours with stirring, whereupon the internal temperature in the reaction system was 88° to 90° C. The reaction mixture was cooled to room temperature, and the crystal formed was taken out by filtration. To the thus obtained crystal was added 80 ml of methanol, and the whole was then heated under reflux for 2 hours, and washed and purified. As a result 6.4 g of (I-9) was obtained.

$\lambda_{max}=461$ nm; $\epsilon_{max}=1.36\times10^4$ (in dimethylformamide)

PRODUCTION EXAMPLE 4 (Production of I-31)

A mixture comprising 5.5 g of 3-butylcarbamoylpyrazolin-5-one, 3.9 g of malonaldehydodianil hydrochloride, 8.3 ml of triethylamine and 50 ml of methanol was stirred for 6 hours at room temperature. After methanol was removed by distillation under reduced pressure, 20 ml of concentrated hydrochloric acid was added to the residue. The crystal formed was then taken out by filtration and suspended in 60 ml of methanol. 30 ml of concentrated hydrochloric acid was added thereto and stirred for 4 hours at room temperature. The crystal formed was taken out by filtration and well washed with water and then dried. As a result, 6 g of (I-31) was obtained.

$\lambda max=566$ nm; $\epsilon_{max}=4.16\times10^4$ (in dimethylformamide)

Next, dyes of formula (II) will be explained in detail hereunder.

The alkyl group to be represented by $R_{21}$, $R_{22}$, $R_{23}$, $R_{24}$, $R_{25}$, $R_{26}$ or $R_{27}$ is preferably one having from 1 to 6 carbon atoms (e.g., methyl, ethyl, n-propyl, n-butyl, n-hexyl, isobutyl, n-pentyl, sec-butyl). It may have substituent(s), for example, selected from a halogen atom (e.g., F, Cl, Br), a cyano group, a nitro group, a carboxylic acid group, a hydroxyl group, a sulfonamido group having from 1 to 10 carbon atoms (e.g., methanesulfonamido, n-propanesulfonamido, n-butanesulfonamido, n-hexanesulfonamido, isopropanesulfonamido, phenylsulfonamido), an amino group having up to 6 carbon atoms (e.g., unsubstituted amino, dimethylamino, diethylamino), an alkoxy group having from 1 to 8 carbon atoms (e.g., methoxy, ethoxy), an aryloxy group having from 6 to 10 carbon atoms (e.g., phenoxy, p-methylphenoxy), an aryl group having from 6 to 10 carbon atoms (e.g., phenyl, 2-chlorophenyl), an ester group having from 2 to 8 carbon atoms (e.g., methoxycarbonyl, ethoxycarbonyl), an acylamino group having from 2 to 8 carbon atoms (e.g., acetamido, n-propanoylamino), a carbamoyl group having from 1 to 8 carbon atoms (e.g., unsubstituted carbamoyl, methylcarbamoyl, n-butylcarbamoyl), and a sulfamoyl group having up to 10 carbon atoms (e.g., unsubstituted sulfamoyl, methylsulfamoyl, phenylsulfamoyl).

The aryl group to be represented by $R_{21}$, $R_{22}$, $R_{23}$, $R_{24}$, $R_{25}$, $R_{26}$ or $R_{27}$ is preferably one having from 6 to 10 carbon atoms (e.g., phenyl, naphthyl). It may have substituent(s), for example, selected from those mentioned above as examples of substituents to be on the alkyl group of $R_{21}$, $R_{22}$, $R_{23}$, $R_{24}$, $R_{25}$, $R_{26}$ or $R_{27}$ and additionally an alkyl group having from 1 to 6 carbon atoms (e.g., methyl, ethyl, t-butyl, n-propyl).

As examples of the 5-membered or 6-membered ring to be formed by $R_{25}$ and $R_{26}$, there are mentioned a pyrrolidone ring and a 2-oxypiperidine ring. As examples of the 5-membered or 6-membered ring to be formed by $R_{26}$ and $R_{27}$, there are mentioned a pyrrolidine ring, a piperidine ring and a morpholine ring.

The methine group to be represented by $L_1$, $L_2$ or $L_3$ may be either substituted or unsubstituted. As examples of substituents, there are mentioned methyl, ethyl, phenyl and dimethylamino groups and chlorine atom. Plural methine groups may be bonded to each other to form a 5-membered or 6 membered ring (for example, cyclopentene ring, cyclohexene ring, 1-chlorocyclohexene ring, 1-dimethylaminocyclopentene ring, 1-morpholinocyclopentene ring).

Specific examples of dyes of formula (II) are mentioned below, which, however, are not intended to restrict the scope of the present invention.

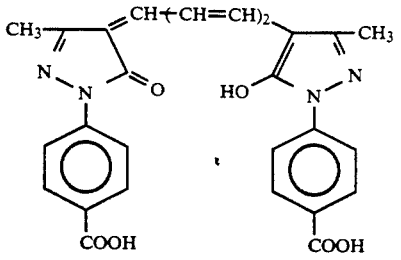
II-1
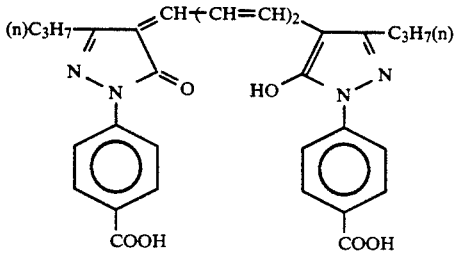
II-2
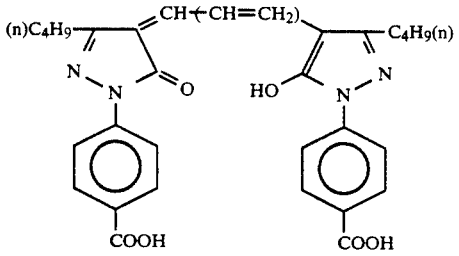
II-3
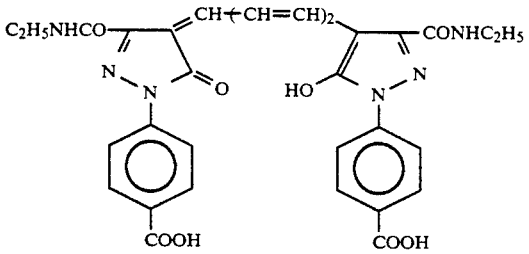
II-4
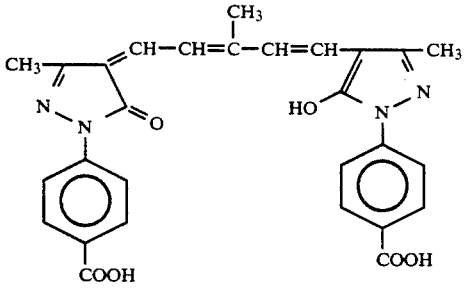
II-6
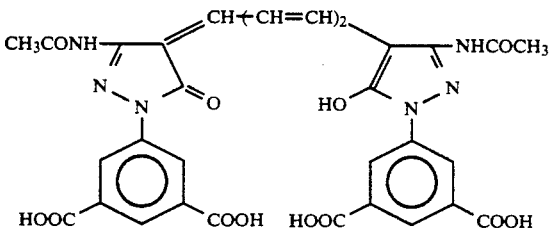
II-7

-continued
II-8
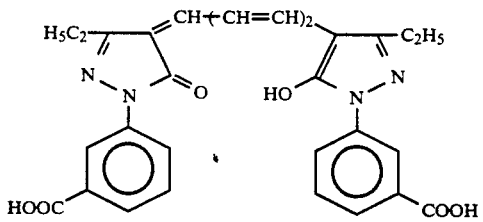
II-9
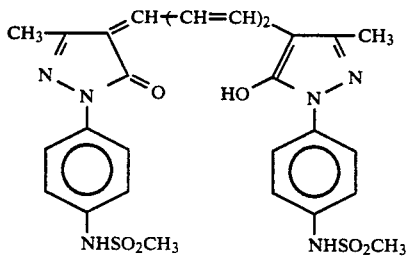
II-11
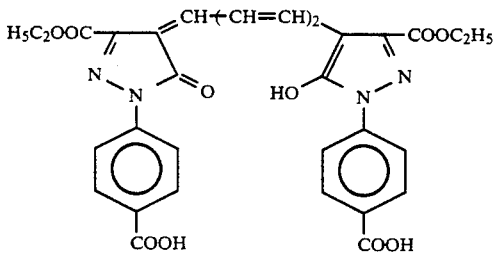
II-12
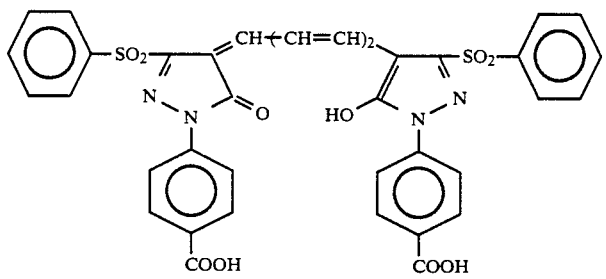
II-13
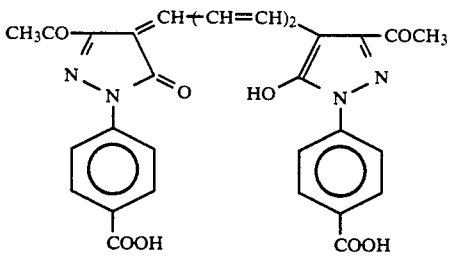
II-14
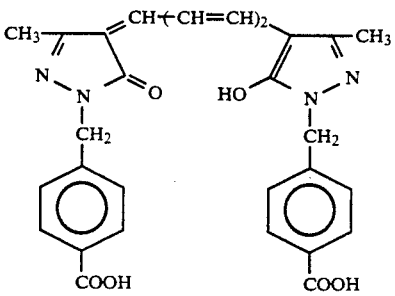

-continued
II-15
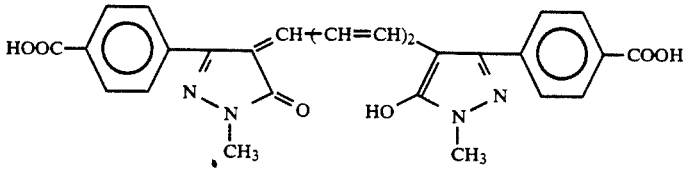
II-16
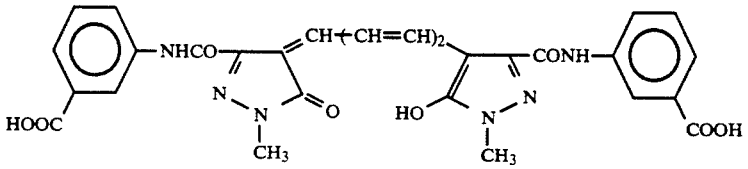
II-17
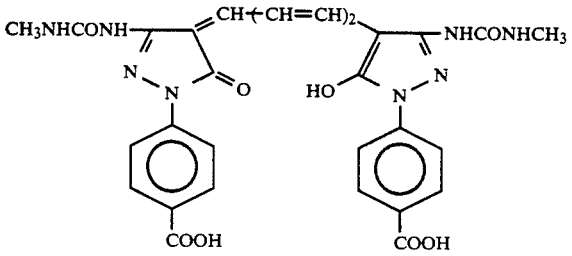
II-18
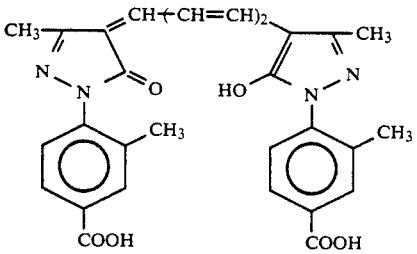
II-19
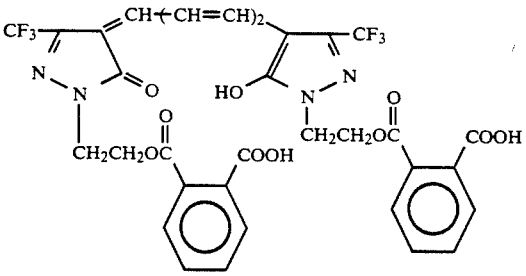
II-20
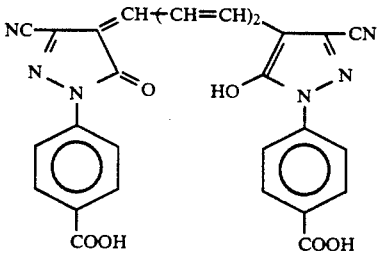
II-21
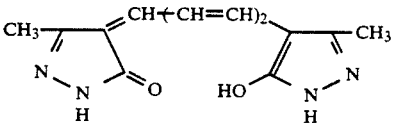

-continued

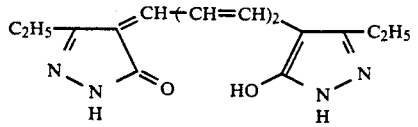

I-22

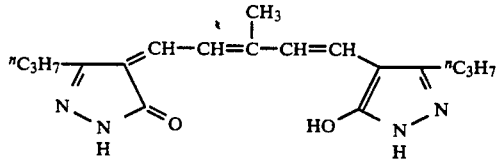

II-23

Dyes of formula (II) are produced by known methods, for example, in accordance with the methods described in JP-A-52-92716 and JP-A-55-120030.

Dyes of formula (I) or (II) are used, in the present invention, in an amount of from 1 to 1000 mg, preferably from 1 to 800 mg, per $m^2$ of the photographic material.

Where dyes of formulae (I) and (II) are used as a filter dye or an anti-halation dye, they may be incorporated into the photographic material in an effective amount for the purpose. Preferably, the amount of the dyes to be incorporated is such that may give an optical density of falling within the range of from 0.05 to 3.5. The dyes may be added to the coating composition at any stage before coating.

The dispersion of fine grains of a dye of formula (I) as well as the dispersion of fine grains of a dye of formula (II) may be added to any of the emulsion layers and other hydrophilic colloid layers of constituting the photographic material of the present invention. The two dispersions may be added together to one and the same layer or separately to different layers.

Dyes of formulae (I) and (II) are added to the layers in the form of a dispersion of fine grains of them. Such a dispersion may be prepared by any desired method. For instance, a method of precipitating a compound of formula (I) or (II) in the form of dispersion and/or a method of grinding a compound of formula (I) or (II) in the presence of a dispersing agent with a known grinding means, for example, by ball milling (with ball mill, shaking ball mill or planet ball mill), sand milling, colloid milling, jet milling or roller milling (in the latter method, a solvent such as water or alcohol may be used) may be employed. Additionally, as still another employable method, a compound of formula (I) or (II) of the invention is dissolved in a pertinent solvent and then a bad solvent is added to the resulting solution so as to precipitate the compound as fine crystals thereof. In the case, a surfactant for dispersion may be used, if desired. As still another employable method, a compound of formula (I) or (II) of the invention is first dissolved with controlling the pH value of the resulting solution and thereafter the pH value is varied so as to form fine crystals of the compound. In the form of the thus formed dispersion, the grain size of the fine crystalline grains of the compound of formula (I) or (II) of the present invention may be 10 μm to 0.01 μm or less, preferably 2 μm to 0.01 μm or less, especially preferably 0.5 μm or less. As the case may be, it is especially preferably in the form of fine grains having a grain size of 0.1 μm to 0.01 μm or less. The grains constituting the dispersion of dye are not limited in grain form and solid state. The grain form may be needle-like, spherical, plate-like, etc. and the solid state of grain may be crystalline or amorphous.

As the hydrophilic colloid of constituting the photographic material of the present invention, gelatin is typical but any other conventional substances known photographically usable may also be used.

The silver halide emulsion of constituting the photographic material of the present invention is preferably made of silver bromide, silver iodobromide, silver iodochlorobromide, silver chlorobromide or silver chloride.

The silver halide grains for use in the present invention are regular crystalline grains such as cubic or octahedral crystal grains, or irregular crystalline grains such as spherical or tabular crystalline grains, or composite crystalline grains composed of such crystalline grains. Further, a mixture comprising various crystalline grains may also be used. Preferably, regular crystalline grains are used.

The silver halide grains for use in the present invention may be such as having different phases in the inside core and the surface layer of one grain or such as having a uniform phase throughout one grain. The grains may be such as forming a latent image essentially on the surface of the grain (for example, negative type emulsion) or such as forming a latent image essentially in the inside of the grain (for example, internal latent image type emulsion, or previously fogged direct reversal type emulsion). Preferably, the grains are such as forming a latent image essentially on the surface of the grain.

The silver halide emulsion for use in the present invention is preferably a tabular grain emulsion which contains tabular grains having a thickness of 0.5 μm or less, preferably 0.3 μm or less, a diameter of preferably 0.6 μm or more and a mean aspect ratio of 5 or more in an amount of 50% or more of the total projected area of all grains, or is preferably a monodisperse emulsion having a statistical fluctuation coefficient of 20% or less. (The statistical fluctuation coefficient indicates distribution of grains in the emulsion in terms of the diameter of the circle derived from the projected area of each grain, and it is a value ($S/\bar{d}$) to be obtained by dividing the standard deviation (S) by the diameter ($\bar{d}$).) If desired, two or more of such tabular grain emulsions and monodisperse emulsions may be blended.

Photographic emulsions for use in the present invention can be prepared by known methods, for example, those described in P. Glafkides, *Chimie et Physique Photographique* (published by Paul Montel, 1967), G. F. Duffin, *Photographic Emulsion Chemistry* (published by Focal Press, 1966), and V. L. Zelikman et al, *Making and Coating Photographic Emulsion* (published by Focal Press, 1964).

In forming silver halide grains, a silver halide solvent may be added so as to control the growth of the grains. For instance, usable as a silver halide solvent for the purpose are ammonia, potassium thiocyanate, ammonium thiocyanate, thioether compounds (such as those described in U.S. Pat. Nos. 3,271,157, 3,574,628, 3,704,130, 4,297,439 and 4,276,374), thione compounds (such as those described in JP-A-53-144319, JP-A-53-82408 and JP-A-55-77737) and amine compounds (such as those described in JP-A-54-100717).

In the step of forming silver halide grains or of physically ripening the grains, a cadmium salt, a zinc salt, a thallium salt, an iridium salt or a complex salt thereof, a rhodium salt or a complex salt thereof, or an iron salt or a complex salt thereof may be added to the reaction system.

As a binder or protective colloid to be in the emulsion layers or interlayers of constituting the photographic material of the present invention, gelatin is advantageously used, but any other hydrophilic colloids may also be used. For instance, examples of usable hydrophilic colloids include proteins, for example, gelatin derivatives, graft polymers of gelatin and other high polymers, albumin or casein; saccharide derivatives, for example, cellulose derivatives such as hydroxyethyl cellulose, carboxymethyl cellulose or cellulose sulfates, as well as sodium alginate or starch derivatives; and various synthetic hydrophilic high polymer substances of homopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole or polyvinyl pyrazole.

As gelatin can be used conventional lime-processed gelatin and acid-processed gelatin as well as an enzyme-processed gelatin as described in *Bull. Soc. Sci. Phot. Japan,* No. 16, page 30 (1966). Additionally, a hydrolysate of gelatin may also be used.

The photographic material of the present invention may contain an inorganic or organic hardening agent in any desired hydrophilic colloid layers of constituting the photographic light-sensitive layers or backing layers. For instance, there are mentioned as specific examples of the agent chromium salts, aldehydes (e.g., formaldehyde, glyoxal, glutaraldehyde) and N-methylol compounds (e.g., dimethylolurea). Additionally, active halogen compounds (e.g., 2,4-dichloro-6-hydroxy-1,3,5-triazine and sodium salt thereof) and active vinyl compounds (e.g., 1,3-bisvinylsulfonyl-2-propanol, 1,2-bis(-vinylsulfonylacetamido)ethane, bis(vinylsulfonylmethyl)ether as well as vinyl polymers having a vinylsulfonyl group in the side chain moiety) are preferred as the agent, as they may rapidly harden gelatin and other hydrophilic colloids to give stable photographic properties. Further, N-carbamoylpyridinium salts (e.g., (1-morpholinocarbonyl-3-pyridinio)methanesulfonate) and haloamidinium salts (e.g., 1-(1-chloro-1-pyridinomethylene)pyrrolidinium-2-naphthalene sulfonate) are also preferred as being able to harden the hydrophilic colloid layers rapidly.

The silver halide photographic emulsions of constituting the photographic material of the present invention can be color-sensitized with methine dyes or other dyes. As usable dyes for the purpose, there are mentioned cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. To these dyes may be applicable any nuclei which are generally used in cyanine dyes as basic heterocyclic nuclei. Precisely, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, and pyridine nuclei; nuclei formed by fusing alicyclic hydrocarbon rings to the said nuclei; and nuclei formed by fusing aromatic hydrocarbon rings to the said nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, and quinoline nuclei. These nuclei may have substituents on the carbon atoms.

To merocyanine dyes or complex merocyanine dyes can be applied 5- or 6-membered heterocyclic nuclei such as pyrazolin-5-one nuclei, thiohydantoin nuclei, 2-thioxazolidine-2,4-dione nuclei, thiazolidine-2,4-dione nuclei, rhodanine nuclei and thiobarbituric acid nuclei, as nuclei having a ketomethylene structure.

These sensitizing dyes can be used singly or in combination of two or more of them. Combination of sensitizing dyes is often used for the purpose of super-sensitization. Dyes which do not have a color-sensitizing activity by themselves or substances which do not substantially absorb visible rays but show super-sensitization can be incorporated into the emulsions of the constituting the photographic material of the present invention, along with sensitizing dyes. For instance, such dyes or substances are nitrogen-containing heterocyclic group-substituted aminostilbene compounds (for example, those described in U.S. Pat. Nos. 2,933,390 and 3,635,721), aromatic organic acid-formaldehyde condensates (for example, those described in U.S. Pat. No. 3,743,510), cadmium salts and azaindene compounds. In particular, combinations described in U.S. Pat. Nos. 3,615,613, 3,615,641, 3,617,295 and 3,635,721 are especially useful.

The silver halide photographic emulsions of constituting the material of the present invention can contain various compounds for the purpose of preventing fogging of the material during manufacture, storage or photographic processing of the material or for the purpose of stabilizing the photographic properties of the material. For instance, various compounds which are known as an antifoggant or stabilizer can be added to the emulsions, and examples of usable compounds are azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially, 1-phenyl-5-mercaptotetrazole); mercaptopyrimidines; mercaptotriazines; thioketo compounds such as oxadolinethione; azaindenes such as triazaindenes, tetrazaindenes (especially, 4-hydroxy-substituted (1,3,3a,7)tetrazaindenes), and pentazaindenes; as well as benzenethiosulfonic acids, benzenesulfinic acids, benzenesulfonic acid amides.

The photographic material of the present invention can contain one or more surfactants for various purposes of coating aid, prevention of static charges, improvement of slide property, improvement of emulsification and dispersion, prevention of surface blocking, and improvement of photographic characteristics (for example, promotion of developability, elevation of hard contrast and sensitization).

The photographic material of the present invention may contain water-soluble dyes in the hydrophilic colloid layers as a filter dye or for the purpose of anti-irradiation or anti-halation or for other various purposes. Such dyes are preferably oxonol dyes, hemioxonol dyes, arylidene dyes, styryl dyes, merocyanine dyes, anthraquinone dyes and azo dyes. Additionally, cyanine dyes, azomethine dyes, triarylmethane dyes and phthalocyanine dyes are also useful. Oil-soluble dyes may be added to the hydrophilic colloid layers of constituting the photographic material of the present invention, if desired, in the form of an emulsion as formed by an oil-in-water dispersion method.

The present invention may be applied to a multi-layered multi-color photographic material having at least two photographic layers each having a different color sensitivity on a support. For instance, it may be applied to a multi-layered natural color photographic material, which generally has at least one red-sensitive emulsion layer, at least one green-sensitive emulsion layer and at least one blue-sensitive emulsion layer. The order of these layers on the support may freely be determined. As preferred examples of the order of these layers, a red-sensitive layer, a green-sensitive layer and a blue-sensitive layer are formed on a support in this order; or a blue-sensitive layer, a green-sensitive layer and a red-sensitive layer are formed thereon in this order; or a blue-sensitive layer, a red-sensitive layer and a green-sensitive layer are formed thereon in this order. Of the color layers, if desired, anyone may be composed of two or more layers each having the same color sensitivity but having a different sensitivity degree for the purpose of elevating the sensitivity. Additionally, the color-sensitive layer may be composed of three layers each having the same color sensitivity but having a different sensitivity degree for the purpose of improving the graininess. Further, a light-insensitive layer may be positioned between two or more emulsion layers each having the same color sensitivity. As the case may be, two adjacent emulsion layers each having the same color sensitivity may be interrupted by a emulsion layer having a different color sensitivity. It is also preferred to provide a reflective layer containing fine silver halide grains below a high-sensitivity layer especially below a high-sensitivity blue-sensitive layer so as to improve the sensitivity.

In general, the red-sensitive emulsion layer contains a cyan-forming coupler, the green-sensitive emulsion layer contains a magenta-forming coupler, and the blue-sensitive emulsion layer contains an yellow-forming coupler. As the case may be, any other combination may also be employed. For instance, an infrared sensitive layer may be combined for forming a pseudo-color photograph or for exposure to semiconductor lasers.

In preparing the photographic material of the present invention, photographic emulsion layers and other layers are coated on a flexible support, for example, conventional plastic films, papers or clothes or on a rigid support such as glasses, porcelains or metals. As examples of usable flexible supports, there are mentioned semi-synthetic or synthetic high polymer films such as cellulose nitrate, cellulose acetate, cellulose acetate butyrate, polystyrene, polyvinyl chloride, polyethylene terephthalate or polycarbonate films; and papers as coated or laminated with a baryta layer or an α-olefin polymer (such as polyethylene, polypropylene, ethylene/butene copolymer). The support may be colored with dyes or pigments. It may be blackened for the purpose of light-shielding. In general, the surface of the support is subbed for the purpose of improving adhesiveness to photographic emulsion layers to be formed thereon. If desired, the surface of the support may be pre-treated, prior to subbing, by glow-discharging, corona-discharging, ultraviolet irradiation or flame treatment.

For forming photographic emulsions and other hydrophilic colloid layers in preparing the photographic material of the present invention, any conventional coating methods may be employed. For instance, a dip coating, roller coating, curtain coating or extrusion coating method can be employed. If desired, plural layers may be coated simultaneously by multi-layer coating, for example, by the methods described in U.S. Pat. Nos. 2,681,294, 2,761,791, 3,526,528 and 3,508,947.

The present invention can be applied to various color photographic materials and black-and-white photographic materials. As specific examples, there are mentioned color negative films for general use or for movies, color reversal films for slides or for television images, color papers, color positive films and color reversal papers, as well as color diffusion transfer type photographic materials and heat-developable color photographic materials. Utilizing the three color coupler-blending technique as disclosed in *Research Disclosure*, No. 17123 (July, 1978) or utilizing the black-coloring couplers as described in U.S. Pat. No. 4,126,461 and British Patent 2,102,136, the present invention may also be applied to black-and-white photographic materials such as X-ray films. Additionally, the present invention may further be applied to photomechanical films such as lith films or scanner films, direct or indirect medical X-ray films, industrial X-ray films, picture-taking negative black-and-white photographic materials, black-and-white photographic papers, microfilms for COM or for general use, silver salt diffusion transfer type photographic materials and print-out type photographic materials.

Where the photographic material of the present invention is applied to color diffusion transfer photography, the material may have any desired film unit constitution of a peel-apart type constitution, an integrated type constitution as described in JP-B-46-16356 and 48-33697, JP A-50 13040 and British Patent 1,330,524, or a non-peel-apart type constitution as described in JP-A-57-119345.

In any format of the above-mentioned constitutions, it is advantageous to use a polymer acid layer as protected with a neutralization-timing layer for the purpose of broadening the acceptable latitude of the processing temperature. Where the photographic material of the present invention is applied to color diffusion transfer photography, the component may be added to any layer of the material or may be trapped in a processing solution container as a component of the developer.

The photographic material of the present invention can be exposed by any desired means. For instance, any desired light source capable of irradiating a radiation having a wavelength corresponding to the wavelength of the sensitivity of the photographic material to be exposed therewith may be used as an illuminating light source or a writing light source. Generally usable are natural light (sun light), incandescent lamp, halogen lamp, mercury lamp, fluorescent lamp, and flash exposure source such as electronic flash or metal combustion flash bulb. A gaseous laser or a dye solution or semiconductor laser, as well as an emitting diode or plasma light source may also be used as a recording light source. Additionally, an exposing means comprising a phosphor plate to be released from a phosphor as excited by electron beams (e.g., CRT) or combination of a micro-shutter array of a liquid crystal device (LCD) or a lanthanum-doped lead titanium-zirconate (PLZT) with a linear or plane-wise light source may also be used. If desired, a color filter may be used in exposure of the photographic material of the present invention so as to control the spectral distribution of the light source for exposure.

The photographic material of the present invention is, after exposed, developed with a color developer, which is preferably an alkaline aqueous solution essentially containing an aromatic primary amine color-developing agent. As the color-developing agent, p-phenylenediamine compounds are preferably used, though aminophenol compounds are also usable. Specific examples of usable p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides and p-toluenesulfonates of these compounds. These diamine are generally stable in the form of their salts rather than in their free forms, and therefore salts of such diamines are preferably used.

The color developer generally contains a pH buffer such as alkali metal carbonates, borates or phosphates; and a development inhibitor or antifoggant such as bromides, iodides, benzimidazoles, benzothiazoles or mercapto compounds. If desired, it may also contain a preservative such as hydroxylamines, dialkylhydroxylamines, hydrazines, triethanolamine, triethylenediamine or sulfites; an organic solvent such as triethanolamine or diethylene glycol; a development accelerator such as benzyl alcohol, polyethylene glycol, quaternary ammonium salts or amines; a dye-forming coupler; a competing coupler; a nucleating agent such as sodium boronhydride; an auxiliary developing agent such as 1-phenyl-3-pyrazolidone; a tackifier; a chelating agent such as aminopolycarboxylic acids, aminopolyphosphonic acids, alkylphosphonic acids or phosphonocarboxylic acids; and an antioxidant such as compounds described in West German Patent Application (OLS) No. 2,622,950.

Where the photographic material of the present invention is a reversal color photographic material, it is first subjected to black-and-white development and then to color development. In the former black-and-white development, a black-and-white developer is used, which contains one or more black-and-white developing agents of dihydroxybenzene such as hydroquinone, 3-pyrazolidones such as 1-phenyl-3-pyrazolidone or aminophenols such as N-methyl-p-aminophenol, singly or in combination of two or more of them.

To the photographic material of the present invention, not only a color developer but also any other photographic developing method may be applied. For instance, as examples of developing agents to be in developers applicable to the present invention, there are mentioned dihydroxybenzene type developing agents, 1-phenyl-3-pyrazolidone type developing agents and p-aminophenol type developing agents, and these may be used singly or in combination of two or more of them (for example, combination of 1-phenyl-3-pyrazolidone compound and dihydroxybenzene compound, or combination of p-aminophenol compound and dihydroxybenzene compound). Additionally, the photographic material of the present invention may also be processed with a so-called infectious developer containing a sulfite ion buffer such as carbonyl bisulfite along with hydroquinone.

As examples of usable dihydroxybenzene type developing agents, there are mentioned hydroquinone, chlorohydroquinone, bromohydroquinone, isopropylhydroquinone, toluhydroquinone, methylhydroquinone, 2,3-dichlorohydroquinone, and 2,5-dimethylhydroquinone; as examples of usable 1-phenyl-3-pyrazolidone developing agents, there are mentioned 1-phenyl-3-pyrazolidone, 4,4-dimehtyl-1-phenyl-3-pyrazolidone, 4-hydroxymethyl-4-methyl-1-phenyl-3-pyrazolidone, and 4,4-dihydroxymethyl-1-phenyl-3-pyrazolidone; and as examples of usable p-aminophenol developing agents, there are mentioned p-aminophenol, and N-methyl-p-aminophenol.

The developer may contain a compound capable of releasing a free sulfite ion, as a preservative. Such a preservative includes, for example, sodium sulfite, potassium sulfite, potassium metabisulfite, and sodium bisulfite. Where an infectious developer is used, it may contain formaldehyde-sodium bisulfite which does not almost release a free sulfite ion in the developer.

As an alkaline agent to be in the developer usable in the present invention, there are mentioned, for example, potassium hydroxide, sodium hydroxide, potassium carbonate, sodium carbonate, sodium acetate, potassium tertiary phosphate, diethanolamine, and triethanolamine. The pH value of the developer is generally defined to be 9 or more, preferably 9.7 or more.

The developer may contain an organic compound which is known as an antifoggant or development inhibitor. Examples of such a compound include azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially, 1-phenyl-5-mercaptotetrazole); mercaptopyrimidines; mercaptotriazines; thioketo compounds such as oxazolinethione; azaindenes such as triazaindenes, tetrazaindenes (especially, 4-hydroxy-substituted (1,3,3a,7)tetrazaindenes), and pentazaindenes; as well as benzenethiosulfonic acid, benzenesulfinic acid, benzenesulfonic acid amide, and sodium 2-mercaptobenzimidazole-5-sulfonate.

The developer usable in the present invention may contain the above-mentioned polyalkylene oxides as a development inhibitor. For instance, it may contain a polyethylene oxide having a molecular weight of from 1000 to 10000 in an amount of from 0.1 to 10 g/liter It is desired that the developer for use in the present invention contains, as a water softener, nitrilotriacetic acid, ethylenedimainetetraacetic acid, triethylenetetraminehexaacetic acid or diethylenetetraaminepentaacetic acid.

The developer for use in the present invention can contain compounds described in JP-A-56-24347 as a silver stain inhibitor; compounds described in JP-A-62-212651 as an uneven development inhibitor; and compounds described in JP-A-61-267759 as a dissolution aid.

The developer for use in the present invention can contain boric acid described in JP-A-62-186259, as well as saccharides (e.g., saccharose), oximes (e.g., acetoxime), phenols (e.g., 5-sulfosalicylic acid) or tertiary phosphates (e.g., sodium or potassium tertiary phosphate) described in JP-A-60-93433, as a buffer.

As a development accelerator, various compounds can be used in the present invention. Such compounds can be added either to the photographic material or to the processing solution. As preferred examples of compounds usable as a development accelerator, there are mentioned amine compounds, imidazole compounds, imidazoline compounds, phosphonium compounds, sulfonium compounds, hydrazine compounds, thioether compounds, thione compounds, mercapto compounds of certain kinds, meso-ionic compounds, and thiocyanate compounds.

Such a development accelerator is especially necessary, when the photographic material is processed by rapid development in a short period of time. The development accelerator is desired to be added to the color developer. As the case may be, however, it may be added to the photographic material, depending upon the kind of the accelerator or upon the position of the light-sensitive layer to be developed acceleratively on the support. If desired, the development accelerator may also be added to both the color developer and the photographic material. It may also be added to a pre-bath before the color developer bath.

Of such amine compounds, usable amino compounds include both inorganic amines such as hydroxylamine and organic amines. Organic amines may be aliphatic amines, aromatic amines, cyclic amines, aliphatic-aromatic amines or heterocyclic amines. All primary, secondary and tertiary amines and quaternary ammonium compounds are effective.

After color-developed, the photographic emulsion layer of the photographic material of the present invention is generally bleached. Bleaching of the developed material may be effected simultaneously with fixation, or the former may be effected separately from the latter. In order to promote the processing of the developed photographic material, a system of bleaching followed by bleach-fixation may also be employed. As examples of usable bleaching agents, there are mentioned polyvalent metal compounds such as compounds of iron(III), cobalt(III), chromium(IV) or copper(II), peracids, quinones, and nitron compounds. Specific examples of such bleaching agents are ferricyanides, bichromates; organic complexes of iron(III) or cobalt(III), such as complexes with aminopolycarboxylic acids, e.g., ethylenediaminetetraacetic acid, diethylenetriaminepentaacetic acid, nitrilotriacetic acid or 1,3-diamino-2-propanoltetraacetic acid, or with organic acids, e.g., citric acid, tartaric acid or malic acid; persulfates; manganates; and nitrosophenol. Of these compounds, preferred are ethylenediaminetetraacetato iron(III) complexes, diethylenetriaminepentaacetato iron(III) complexes and persulfates, as they are usable in rapid processing and are free from environmental pollution. Ethylenediaminetetraacetato iron(III) complexes can be used in either an independent bleaching solution or in a combined mono-bath bleach-fixing solution.

If desired, a bleaching accelerator may be added to the bleaching solution or bleach-fixing solution or to the pre-bath of the solution. As examples of usable bleaching accelerators, there are mentioned mercapto group- or disulfido group-having compounds described in U.S. Pat. No. 3,893,858, West German Patents 1,290,812 and 2,059,988, JP-A-53-32736, JP-A-53-57831, JP-A-53-37418, JP-A-53-65732, JP A-53-72623, JP-A-53-95630, JP-A-53-95631, JP-A-53-104232, JP-A-53-124424, JP-A-53-141623 and JP-A-53-28426 and Research Disclosure, No. 17129 (July, 1978); thiazolidine derivatives described in JP-A-50-140129; thiourea derivatives described in JP-B-45-8506, JP-A-52-20832, JP A 53-32735, and U.S. Pat. No. 3,706,561; iodides described in West German Patent 1,127,715, and JP-A-58-16235; polyethyleneoxides described in West German Patents 966,410 and 2,748,430; polyamine compounds described in JP-B-45-8836; other 163940, as well as iodide ion and bromide ion. Above all, mercapto group- or disulfido group-having compounds are preferred, as having a large accelerating activity, and those described in U.S. Pat. No. 3,893,858, West German Patent 1,290,812 and JP-A-53-95630 are especially preferred. Additionally, the compounds described in U.S. Pat. No. 4,552,834 are also preferred. These bleaching accelerators may be added to the photographic material. Where the photographic material of the present invention is a picture-taking color photographic material, use of such a bleaching accelerator in bleach-fixation of the material is especially effective.

As a fixing agent to be in the fixing solution or bleach-fixing solution to be applied to the photographic material, usable are thiosulfates, thiocyanates, thioether compounds, thioureas, and a large amount of iodides. Generally used are thiosulfates. As a preservative to be in the bleach-fixing solution or fixing solution, for example, sulfites, bisulfites or carbonyl-bisulfite adducts are preferred.

After bleach-fixed or fixed, the photographic material is generally rinsed in water or stabilized. In the rinsing or stabilizing step, various known compounds may be added to the bath for the purpose of prevention of precipitation or of economization of water. For instance, for the purpose of prevention of precipitation, a water softener such as inorganic phosphoric acids, aminopolycarboxylic acids, organic aminopolyphosphonic acids or organic phosphoric acids; a bactericide or fungicide for preventing propagation of various bacteria, algae or fungi; a metal salt such as magnesium salts, aluminium salts or bismuth salts; a surfactant for preventing drying load or drying unevenness; and a hardening agent of various compounds can be added to the rinsing bath or stabilizing bath. Compounds described in L. E. West, Photo. Sci. Eng., Vol. 6, pp. 344 to 359 (1965) can also be added for the purpose. Addition of a chelating agent and a fungicide is especially effective.

In the rinsing step, two or more tanks are generally combined in a countercurrent rinsing system so as to economize the water to be used in the step. Further, a multi-stage countercurrent stabilizing system as described in JP A-57-8543 may also be employed instead of the rinsing step. In the case of the system, from 2 to 9 countercurrent bathes are necessary. To the stabilization bathes are added various compounds for the purpose of stabilizing the images formed, in addition to the above-mentioned additives. For instance, typical examples of the compounds are various buffers so as to adjust the pH value of the film (for example, to pH of from 3 to 9), such as borates, metaborates, borax, phosphates, carbonates, potassium hydroxide, sodium hydroxide, aqueous ammonia, monocarboxylic acids, dicarboxylic acids and polycarboxylic acids, which are used in combination of two or more of them, as well as aldehydes such as formalin. In addition, the stabilizing solution may further contain, if desired, other various additives, such as a chelating agent (e.g., inorganic phosphoric acids, aminopolycarboxylic acids, organic phosphoric acids, organic phosphonic acids, aminopolysulfonic acids, phosphonocarboxylic acids), a bactericide (benzisothiazolinone, isothiazolone, 4-thiazolinebenzimidazole, halogenated phenols, sulfanylamide, benzotriazole), a surfactant, a brightening agent and a hardening agent. Two or more compounds of the same kind or different kinds may be used in combination.

As a pH adjusting agent for adjusting the pH value of the processed film, various ammonium salts are preferably added to the rinsing or stabilizing solution. Such salts are, for example, ammonium chloride, ammonium nitrate, ammonium sulfate, ammonium phosphate, ammonium sulfite and ammonium thiosulfate.

Where the photographic material of the invention is a picture-taking color photographic material, it may be processed by the above-mentioned stabilizing step and water-rinsing step (with economization of water) in place of the conventional step of water-rinsing followed by stabilization which is generally effected after fixation. In the case, where the photographic material contains a 2-equivalent magenta coupler, formalin in the stabilizing bath may be removed.

The water-rinsing time or stabilizing time in processing the photographic material of the present invention varies, depending upon the kind of the photographic material being processed as well as upon the processing condition. In general, it may be from 20 seconds to 10 minutes, preferably from 20 seconds to 5 minutes.

The silver halide color photographic material of the present invention can contain a color developing agent for the purpose of simplifying and promoting the processing of the material. Where the agent is incorporated into the material, various precursors of color developing agents are preferably used. For instance, such precursors include indaniline compounds described in U.S. Pat. No. 3,342,597; Schiff base type compounds described in U.S. Pat. No. 3,342,599 and *Research Disclosure* No. 14850 and No. 15159; aldol compounds described in *Research Disclosure* No. 13924; metal complexes described in U.S. Pat. No. 3,719,492; urethane compounds described in JP-A-53-135628; as well as various salt precursors described in JP-A-56-6235, JP-A-56-16133, JP-A-56-59232, JP-A-56-67842, JP-A-56-83734, JP-A-56-83735, JP-A 56-83736, JP-A-56-89735, JP-A-56-81837, JP-A-56-54430, JP-A-56-106241, JP-A-56-107236, JP-A-57 97531 and JP A-57-83565.

The silver halide color photographic material of the present invention can contain, if desired, various 1-phenyl-3-pyrazolidones for the purpose of accelerating color development of the material. Typical examples of compounds usable for the purpose are described in, for example, JP-A-56-64339, JP-A-57-144547, JP-A-57-211147, JP-A-58 50532, JP-A-58-50536, JP-A-58-50533, JP-A-58-50534 JP-A-58-50535 and JP A 58-115438.

In processing the photographic material of the present invention, various processing solutions are used generally at a temperature of 10° C. to 50° C. A temperature of falling within the range between 33° C. and 38° C. is standard. However, a higher temperature may be employed for the purpose of accelerating the processing to shorten the processing time; or a lower temperature may also be employed for the purpose of improving the quality of the image to be formed and of improving the stability of the processing solutions. For the purpose of economizing silver to be used in the photographic material, processing with cobalt intensification or hydrogen peroxide intensification, as described in West German Patent 2,226,770 and U.S. Pat. No. 3,674,499, may also be employed.

The processing bathes may have a heater, a temperature sensor, a liquid level sensor, a circulating pump, a filter, a floating lid and a squeegee, if desired.

Where the photographic material of the present invention is processed by a continuous processing system, replenishers may be added to the respective processing tanks so as to prevent fluctuation of the composition of each processing solution. Accordingly, constant finish may be attained in the continuous process. The amount of the replenisher to each processing solution may be reduced to a half or less of a standard amount for the purpose of reducing the processing cost.

Where the photographic material of the present invention is a color paper, it may be bleach-fixed just ordinarily. If it is a picture-taking color photographic material, it may additionally be bleach-fixed, if desired.

In the silver halide photographic material of the present invention, the dye of formula (I) or (II), which has a pertinent spectral absorption, is selectively contained in a determined layer and it does not diffuse to any other layer. The dye of formula (I) or (II) is easily decolored or dissolved out when the material is processed. Accordingly, the material may have a low Dmin and a high sensitivity. Additionally, decrease of the sensitivity after storage of the material is little. Addition of the dye of formula (I) or (II) to the photographic material thus gives various advantageous merits.

Furthermore, the silver halide photographic material of the present invention may form an image with an improved sharpness. The photograph to be obtained from the silver halide photographic material of the present invention is free from formation of stains and is stable even after storage for a long period of time, without worsening the photographic properties.

Next, the present invention will be explained in more detail by way of the following examples, which, however, are not intended to restrict the scope of the present invention.

EXAMPLE 1

Preparation of Emulsion (A)

An aqueous silver nitrate solution and an aqueous sodium chloride solution containing ammonium hexachlororhodate(III) in an amount of $0.5\times10^{-4}$ mol per mol of silver were mixed in a gelatin solution having a temperature of 35° C., by a double jet method, while the pH value in the reaction system was controlled to be 6.5. Accordingly, a monodisperse silver chloride emulsion having a mean grain size of 0.07 μm was obtained.

After formation of the grains, soluble salts were removed from the emulsion by a well known flocculation method. Next, 4-hydroxy-6-methyl-1,3,3a,7-tetrazaindene and 1-phenyl-5-mercaptotetrazole were added to the emulsion as a stabilizer. The amount of gelatin in the thus formed emulsion was 55 g per kg of the emulsion; and that of silver was 105 g per kg of the same. The emulsion was called Emulsion (A).

Preparation of Photographic Material Sample

The following nucleating agents and nucleation accelerators were added to the Emulsion (A). Then, polyethyl acrylate latex (300 mg/m$^2$) and a hardening agent of 2,4-dichloro-6-hydroxy-1,3,5-triazine sodium salt were added thereto.

| | Amount Added ($mg/m^2$) |
|---|---|
| Nucleating Agents | |
| 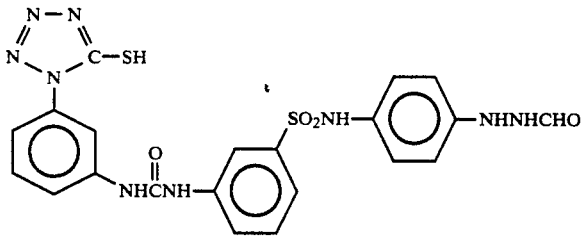 | 11.8 |
| 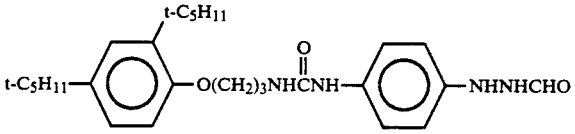 | 9.3 |
| Nucleation Accelerators | |
| 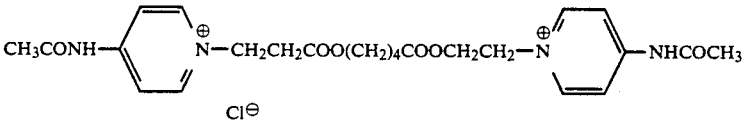 | 28.0 |
| 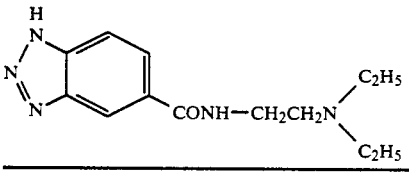 | 60.0 |

The resulting emulsion was coated on a transparent polyethylene terephthalate support in an amount of 3.5 $g/m^2$ as silver to form a silver halide emulsion layer thereon. Additionally, a protective layer containing gelatin (1.3 $g/m^2$), Compound (I-7) (0.1 $g/m^2$) and, as coating aids, the following three surfactants, stabilizer and matting agent, was coated over the emulsion layer and dried. The photographic material sample thus prepared was called Sample No. 1.

| | Amount Added ($mg/m^2$) |
|---|---|
| Surfactants | |
| 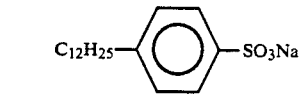 | 37 |
| $CH_2COOC_6H_{13}$<br>\|<br>$CHCOOC_6H_{13}$<br>\|<br>$SO_3Na$ | 37 |
| $C_8F_{17}SO_2N(C_3H_7)CH_2COOK$ | 2.5 |
| Stabilizer | |
| Thioctic Acid | 6.0 |
| Matting Agent | |
| Polymethyl methacrylate (mean grain size 3.5 μm) | 50.0 $mg/m^2$ |

Compound (I-7) was incorporated into the protective layer in the form of a dispersion thereof, which was prepared as mentioned below.

| Preparation of Dispersion of Dye of Compound (I-7): | |
|---|---|
| Solution I: | |
| Dye of Compound (I-7) | 26 g |
| Dimethylformamide | 53 ml |
| Citric Acid | 0.1 g |
| Solution II: | |
| Gelatin | 60 g |
| $H_2O$ | 830 ml |
| Phenol (10%) | 12 ml |
| $C_{11}H_{23}CONH(CH_2)_3N^+(CH_3)_2(CH_2)_4SO_3^-$ | 17 g |

Solution II was stirred at 40° C., to which Solution I was gradually added little by little.

Preparation of Comparative Sample

A comparative sample was prepared in the same manner as in preparation of Sample No. 1, except that the following dye was used in place of Compound (I-7).

Dye:

-continued

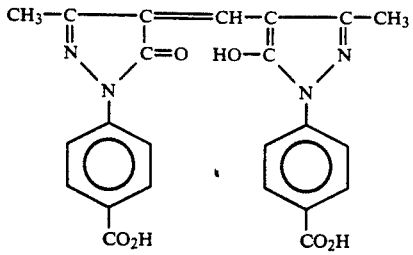

(0.075 g/m²)

Evaluation of Photographic Properties (1) Decoloration Test

The both samples were exposed with a daylight printer Model P-607 (manufactured by Dai-Nippon Screen Co.) through an optical wedge and then developed with the following developer at 38° C. for 20 seconds. These were then fixed, rinsed in water and dried by a conventional method.

| Basic Composition of Developer: | |
|---|---|
| Hydroquinone | 35.0 g |
| N-methyl-p-aminophenol ½-Sulfate | 0.8 g |
| Sodium Hydroxide | 13.0 g |
| Potassium Tertiary Phosphate | 74.0 g |
| Potassium Sulfite | 90.0 g |
| Tetrasodium Ethylenediaminetetraacetate | 1.0 g |
| Potassium Bromide | 4.0 g |
| 5-Methylbenzotriazole | 0.6 g |
| 3-Diethylamino-1,2-propanediol | 15.0 g |
| Water to make | 1 liter |
| pH | 11.5 |

As a result, the sample of the present invention was completely decolored, while the comparative sample had yellow stains. The development time for the comparative sample was prolonged to 30 seconds, whereupon the sample was completely decolored. From the results, it is understood that the dye compound (I-7) of the invention is more rapidly processed and decolored than the comparative dye.

(2) Tone Variability Test

The above-mentioned two samples were exposed with the above-mentioned printer through a plane dot screen and then developed in the same way as in Test (1). For each sample, the exposure time capable of conducting 1/1 contact work of the dot area was determined. The samples were exposed for a period of two times or four times of the determined exposure time, whereupon the enlarged proportion of the dot area was checked. In the test, larger enlargement of the dot area indicates an excellent tone variability. The results obtained are shown in Table 1 below. As is obvious from Table 1, both the comparative sample and the sample of the present invention had a high tone variability.

TABLE 1

| | Tone Variability (increase of dot area) | |
|---|---|---|
| | Two time exposure | Four time exposure |
| Comparative Sample | +5% | +8% |
| Sample of the Invention | +6% | +9% |

As is obvious from the results of the above-mentioned tests, the sample of the present invention had excellent decolorability and tone variability.

EXAMPLE 2

(1) Preparation of Tabular Silver Iodobromide Grain Emulsion 5 g of potassium bromide, 0.05 g of potassium iodide, 30 g of gelatin and 0.125 g of thioether ($HO(CH_2)_2S(CH_2)_2S(CH_2)_2OH$) were added to one liter of water and the resulting solution was kept at 75° C. Then, an aqueous solution of 8.33 g of silver nitrate and an aqueous solution containing 5.94 g of potassium bromide and 0.726 g of potassium iodide were added to the solution with stirring over a period of 45 seconds by a double jet method. Subsequently, 2.5 g of potassium bromide was added thereto, and thereafter an aqueous solution containing 8.33 g of silver nitrate was added thereto over a period of 7 minutes and 30 seconds at such an accelerated flow rate that the flow amount at the finish of addition was two times of that at the start of addition. Next, an aqueous solution of 153.34 g of silver nitrate and an aqueous solution of potassium bromide were added to the emulsion over a period of 25 minutes with maintaining the pAg potential of being 8.1 by a controlled double jet method, whereby the grains were grown. The flow rate in the method was so accelerated that the flow amount at the finish of addition was eight times of that at the start of addition. After addition, 15 ml of 2N potassium thiocyanate solution was added to the emulsion, and 50 ml of 1% aqueous potassium iodide solution was added thereto over a period of 30 seconds. Next, the temperature of the emulsion was lowered to 35° C., and soluble salts were removed by flocculation. Then, the emulsion was heated up to 40° C., and 68 g of gelatin, 2 g of phenol and 7.5 g of trimethylolpropane were added thereto. Further, sodium hydroxide and potassium hydroxide were added thereto, whereby the emulsion was adjusted to have a pH value of 6.40 and a pAg value of 8.45.

Next, the emulsion was further heated up to 56° C., and 620 mg of a sensitizing dye having the structural formula mentioned below and 160 mg of 4-hydroxy-6-methyl-1,3,3a,7-tetrazaindene were added thereto. After 10 minutes, 8.2 mg of sodium thiocyanate pentahydrate, 163 mg of potassium thiocyanate and 5.4 mg of chloroauric acid were added to the emulsion. After 5 minutes, it was rapidly cooled for solidification. The emulsion thus obtained contained tabular grains having an aspect ratio of 3 or more in a proportion of 93% of the total projected area of all grains. In the emulsion, the mean diameter of the projected area of all the grains having an aspect ratio of 2 or more was 0.83 μm, the standard deviation of all the grains was 18.5%, the mean thickness thereof was 0.161 μm, the mean aspect ratio thereof was 5.16 and the mean iodine content thereof was 0.8 mol %.

Sensitizing Dye:

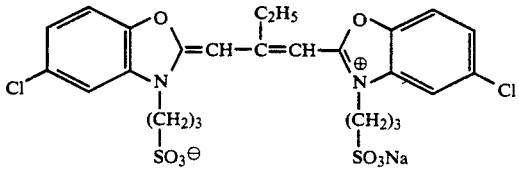

(2) Preparation of Emulsion-Coating Composition

The following chemicals were added to the emulsion as prepared in the above step (1). The amount indicated below is per mol of the silver halide in the emulsion.

| | |
|---|---|
| 2,6-Bis(hydroxyamino)-4-diethylamino-1,3,5-triazine | 80 mg |
| 1,4-Dihydroxy-3-potassium Sulfate | 9.3 g |
| Sodium Polyacrylate (mean molecular weight: 41,000) | 4.0 g |

(3) Preparation of Surface-Protecting Layer-Coating Composition

An aqueous solution comprising the components mentioned below was coated to form a surface-protecting layer. The amount indicated below is a dry weight of each component per one surface.

| | |
|---|---|
| Gelatin | 1.2 g/m$^2$ |
| Dextran | 0.4 g/m$^2$ |
| Polyacrylamide | 0.4 g/m$^2$ |
| Sodium Polyacrylate | 0.02 g/m$^2$ |
| Potassium Polystyrenesulfonate | 0.02 g/m$^2$ |
| Poly(methyl methacrylate/-methacrylic acid, 9/1, by mol) (grain size: 4.3 μm) | 0.05 g/m$^2$ |
| Dimethylsiloxane (as dispersed in dodecylbenzenesulfonic acid) (grain size 0.11 μm) | 0.03 g/m$^2$ |
| Cetyl Palmitate (as dispersed in sodium dioctyl α-sulfosuccinate) (grain size: 0.10 μm) | 0.03 g/m$^2$ |
| Colloidal Silica | 0.15 g/m$^2$ |
| Potassium Nitrate | 0.06 g/m$^2$ |
| Sodium Dioctyl α-sulfosuccinate | 0.005 g/m$^2$ |
| Dodecylbenzenesulfonic Acid | 0.005 g/m$^2$ |
| Sodium p-Octylphenoxyethoxy-ethoxyethoxyethanesulfonate | 0.005 g/m$^2$ |
| Sodium p-Octylphenoxy-triglycidylbutanesulfonate | 0.005 g/m$^2$ |
| Poly(degree of polymerization: 10)-oxyethylene Cetyl Ether | 0.02 g/m$^2$ |
| Poly(degree of polymerization: 10)-oxyethylene Poly(degree of polymerization: 3)oxyglyceryl Octylphenyl Ether | 0.005 g/m$^2$ |
| Poly(degree of polymerization: 10)-oxyethylene Poly(degree of polymerization: 3)glyceryl Cetyl Ether | 0.005 g/m$^2$ |
| Poly(degree of polymerization: 10)-glyceryl Dodecyl Ether | 0.005 g/m$^2$ |
| Poly(degree of polymerization: 10)-glyceryl p-Nonylphenyl Ether | 0.005 g/m$^2$ |
| $C_8F_{17}SO_2N(C_3H_7)(CH_2CH_2O)_n(CH_2)_4SO_3Na$ (n ≐ 4) | 0.002 g/m$^2$ |
| $C_8F_{17}SO_2-N(C_3H_7)(CH_2CH_2O)_nH$ (n ≐ 16) | 0.005 g/m$^2$ |
| 4-Hydroxy-6-methyl-1,3,3a,7-tetrazaindene | 0.03 g/m$^2$ |

(4) Coating of Subbing Layer to Support

A biaxially stretched polyethylene terephthalate film having a thickness of 175 μm was treated by corona-discharging, and a first subbing layer-coating composition comprising the components mentioned below was coated on one surface in an amount of 5.1 ml/m$^2$ with a wire bar coater. This was then dried at 175° C. for one minute. Next, the same first subbing layer was coated on the opposite surface.

| Composition of First Subbing Layer: | |
|---|---|
| Butadiene-styrene Copolymer Latex solution(*) (solid content 40%; butadiene/styrene = 31/69, by weight) | 79 ml |
| 2,4-Dichloro-6-hydroxy-s-triazine Sodium Salt (4% solution) | 20.5 ml |
| Distilled Water | 900.5 ml |

(*) Latex solution contained an emulsifying and dispersing agent of:

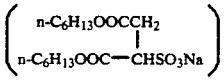

in an amount of 0.4% by weight to the latex solid content.

(5) Preparation of Dispersion of Fine Solid Grains of Dye

Compound (I-24) of the invention was treated in a ball mill, as mentioned below.

Precisely, zirconium oxide beads were added to a mixture of water, surfactant of Triton-X 200® and the dye (Compound (I-24)) in a ball mill container. The container was firmly closed with a stopper and set in a mill device. The content was milled for 4 days. Then, the thus milled content was dispersed in an aqueous gelatin solution and then treated in a roll mill for 10 minutes to reduce the bubbles. After the treatment, the beads were removed from the content. The weight ratio of the dye to gelatin was 1/1, and the content of the dye in 100 g the resulting gelatin dispersion was 1.4 g.

(6) Coating of Dye Dispersion-Containing Subbing Layer to Support

A second subbing layer comprising the components mentioned below was coated and dried over the both surfaces of the first subbing layer as previously coated on the support. The amount of the second subbing layer as coated on one surface was 8.5 ml/m$^2$. Thus, a film sample was obtained.

| Composition-4 of Second Subbing Layer: | |
|---|---|
| Gelatin | 10 g |
| Matting Agent (Polymethyl Methacrylate having mean grain size of 2.5 μm) | 0.3 g |
| 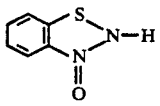 | 0.35 g |
| $C_4H_9(C_2H_5)CHCH_2OCOCH_2$ / $C_4H_9(C_2H_5)CHCH_2OCOCHSO_3Na$ | 0.2 g |
| Dispersion of Fine Solid Grains of Dye (prepared in (5)) (as dye) | 12.0 g |
| Emulsion (4%) of the following Dye: | 27.45 g |

-continued

Composition-4 of Second Subbing Layer:

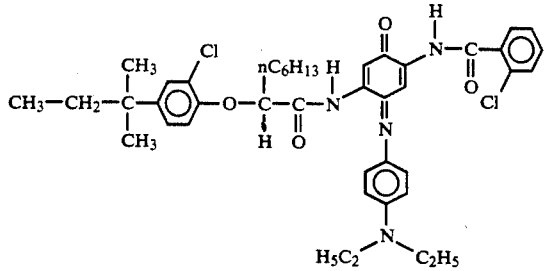

Water to make one liter (7) Preparation of Photographic Material Samples

The emulsion-coating composition of (2) and the surface-protecting layer-coating composition of (3) were coated on the both surfaces of a polyethylene terephthalate support, which had been coated with the subbing layer of (6), as indicated in Table 2 below, and dried. Coating was effected on one surface and then on the other surface in the same way, both by a co-extrusion method. The thus coated sample was called Photographic Material Sample (2-1).

Other Photographic Material Samples (2-2) to (2-6) were prepared in the same manner as in preparation of Sample (2-1), except that the dye compound to be in the second subbing layer in the form of a dispersion of fine solid grains thereof was replaced by the compound as indicated in Table 2.

In all samples, the amount of silver coated on the both surfaces was 4.0 g/m$^2$ (that is, the amount of silver coated on one surface was 2.0 g/m$^2$); and the amount of gelatin in the surface-protecting layer coated on one surface was 1.2 g/m$^2$ as indicated in (3). Just before coating, a hardening agent of 1,2-bis(vinylsulfonylacetamido)ethane was added to the emulsion-coating composition in an amount of 6 mmol/100 g (of gel).

(8) Evaluation of Photographic Properties

Using G-3 Model Screen of GRENEX Series (manufactured by Fuji Photo Film Co., Ltd.), Photographic Material Samples (2-1) to (2-6) were exposed by an ordinary contact exposure method. Briefly, each of Samples (2-1) to (2-6) was inserted between two sheets of G-3 Model Screen and subjected to X-ray exposure through a 10 cm-water phantom.

The exposed samples were then developed with a developer of RD-III (product by Fuji Photo Film Co., Ltd.) at 35° C. and thereafter fixed with a fixer of Fuji F (product by Fuji Photo Film Co., Ltd.), using an automatic developing machine of FPM-4000 Model (manufactured by Fuji Photo Film Co., Ltd.).

The sensitivity of each sample was represented by a relative sensitivity based on the sensitivity of Sample (2 6) of being 100.

(9) Measurement of Sharpness (MTF)

Using the combination of the above-mentioned G-3 Model Screen and automatic developing machine, MTF of each sample was measured. For the measurement, an aperture of 30 μm×500 μm was used. Using the MTF value of 1.0 cycle/mm as the space frequency, the part having an optical density of 1.0 was evaluated.

(10) Evaluation of Color Retention

Evaluation of the color retention of the processed samples was effected in accordance with the process mentioned below. First, non-exposed samples were processed with FPM-4000 Model automatic developing machine, where an exhausted developer having a low pH value was used at a developing temperature of 31° C. and the temperature of the rinsing water was 10° C. That is, the samples were processed under such a forcedly deteriorated processing condition. On the other hands, non-exposed samples were processed with the same FPM-4000 Model automatic developing machine under a normal condition for 90 seconds, where a normal developer was used, the developing temperature was 35° C., and the rinsing temperature was 25° C. In accordance with the latter normal condition, the processed samples had no substantial color retention. The sample as processed under the former (forcedly deteriorated) condition was compared with the corresponding sample as processed under the latter (normal) condition, whereupon the color retention was evaluated with the naked eye. Evaluation was effected by five ranks. (A) means no substantial difference between the two samples (as processed under the both conditions); (B) means that the sample as processed under the former condition was slightly inferior to the sample as processed under the latter condition; (C) means that the sample as processed under the former condition was somewhat inferior to the sample as processed under the latter condition, but the sample is within an acceptable range in view of the former forcedly deteriorated condition; (D) means that the sample as processed under the former condition was fairly inferior to the sample as processed under the latter condition, and the sample is outside an acceptable or practical range; and (E) means that the sample as processed under the former condition was extremely inferior to the sample as processed under the latter condition, and the sample is completely outside the practical range.

The results obtained are shown in Table 2 below.

As is obvious from the results in Table 2, the samples of the present invention are much better than the conventional sample of containing a solid dispersion of a conventional dye (Sample 2-4), in the point of the decolorability after processing. On the other hand, Sample (2-5) containing a conventional dye in the form of a uniform dispersion had a good decolorability, but it had a poor MTF value.

TABLE 2

| Sample | Dispersion of Fine Grains of Dye: Compound | Dispersion of Fine Grains of Dye: Content on One Surface (mg/m$^2$) | Relative Sensitivity | MTF | Color Retention |
|---|---|---|---|---|---|
| 2-1 (Sample of the invention) | I-24 | 80 | 87 | 0.82 | A |
| 2-2 (Sample of the invention) | I-26 | 80 | 84 | 0.85 | B |
| 2-3 (Sample of the invention) | I-32 | 80 | 89 | 0.80 | B |
| 2-4 (Comparative sample) | Comparative Compound (1) | 80 | 84 | 0.85 | E |
| 2-5 (Compara- | Compara- | 80 | 81 | 0.77 | B |

TABLE 2-continued

| Sample | Dispersion of Fine Grains of Dye: Compound | Content on One Surface (mg/m²) | Relative Sensitivity | MTF | Color Retention |
|---|---|---|---|---|---|
| tive sample) | tive Compound (2) | | | | |
| 2-6 (Comparative sample) | — | — | 100 | 0.74 | A |

(*) Comparative Compound (2) was uniformly dissolved during the preparation of dispersion.

Comparative Compounds (1) and (2) are as follows:

Comparative Compound (1): Described in JP-A-64-40827

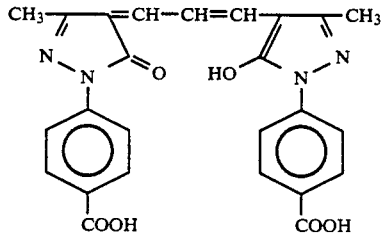

Comparative Compound (2):

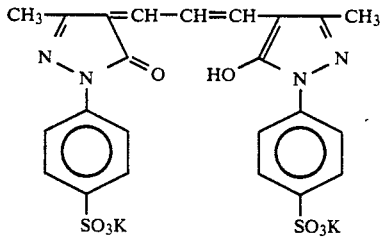

Preparation of Emulsion (A)

Formation of nuclei was effected by adding an aqueous solution of 2.9M silver nitrate and an aqueous halide solution containing 3.0M sodium chloride and $5.3\times10^{-5}$M ammonium hexachlororhodate(III) to an aqueous gelatin solution containing sodium chloride and having a pH value of 2.0, with stirring at 38° C. over a period of 4 minutes under a constant potential of 100 mV. After one minute, an aqueous solution of 2.9M silver nitrate and an aqueous halide solution containing 3.0M sodium chloride were added thereto at 38° C. at a rate of a half of that employed in the previous formation of nuclei, over a period of 8 minutes under a constant potential of 100 mV. Next, the resulting emulsion was washed with water by an ordinary flocculation method, gelatin was added thereto, and it was adjusted to have a pH value of 5.7 and a pAg value of 7.4. As a stabilizer, 5,6-trimethylene-7-hydroxy-s-triazolo(2,3-a)pyrimidine was added thereto in an amount of 0.05 mol per mol of silver. The grains thus formed were cubic silver chloride grains containing Rh in an amount of $8.0\times10^{-6}$ mol per mol of silver and having a mean grain size of 0.13 μm. The fluctuation coefficient was 11%.

Preparation of Emulsion (B)

Formation of nuclei was effected by adding an aqueous solution of 2.9M silver nitrate and an aqueous halide solution containing 2.6M sodium chloride, 0.4M potassium bromide and $5.3\times10^{-5}$M ammonium hexachlororhodate(III) to an aqueous gelatin solution containing sodium chloride and having a pH value of 2.0, with stirring at 40° C. over a period of 4 minutes under a constant potential of 85 mV. After one minute, an aqueous solution of 2.9M silver nitrate and an aqueous halide solution containing 2.6M sodium chloride and 0.4M potassium bromide were added thereto at 40° C. at a rate of a half of that employed in the previous formation of nuclei, over a period of 8 minutes under a constant potential of 85 mV. Next, the resulting emulsion was washed with water by an ordinary flocculation method, gelatin was added thereto, and it was adjusted to have a pH value of 5.7 and a pAg value of 7.4. As a stabilizer, 6-methyl-4-hydroxy-1,3,3a,7-tetrazaindene was added thereto in an amount of $3.0\times10^{-3}$ mol per mol of silver. The grains thus formed were cubic silver chlorobromide grains containing Rh in an amount of 8.0633 $10^{-6}$ mol per mol of silver and having a mean grain size of 0.16 μm. The Br content was 15%, and the fluctuation coefficient was 12%.

To each of the thus prepared Emulsions (A) and (B) were added 2.5 mg/m² of 1-phenyl-5-mercaptotetrazole and 770 mg/m² of ethyl acrylate latex (having a mean grain size of 0.05 μm). Additionally, 126 mg/m² of 2-bis(vinylsulfonylacetamido)ethane was added thereto as a hardening agent. The resulting emulsion composition was coated on a polyester support in an amount of 3.6 g/m² as silver. The amount of gelatin coated was 1.5 g/m².

Over the emulsion layer thus coated, a lower protective layer comprising 0.8 g/m² of gelatin, 8 mg/m² of lipoic acid and 230 mg/m² of ethyl acrylate latex (having a mean grain size of 0.05 μm) was coated; and an upper protective layer comprising 3.2 g/m² of gelatin and a dye (either a dye of the invention or a comparative dye) as indicated in Table 3 below was superposed thereover. The upper protective layer further contained 55 mg/m² of a matting agent (silicon dioxide having a mean grain size of 3.5 μm), 135 mg/m² of methanol silica (having a mean grain size of 0.02 μm), 25 mg/m² of a coating aid of sodium dodecylbenzenesulfonate, 20 mg/m² of sodium salt of poly(degree of polymerization: 5)oxyethylene nonylphenyl ether sulfate and 3 mg/m² of potassium salt of N-perfluorooctanesulfonyl-N-propylglycine. Accordingly, photographic material samples as indicated in Table 3 below were prepared.

The support used here had a backing layer and a backing layer protecting layer each having the composition mentioned below. (The swelling degree of the surface of the support under the backing layer was 110%).

| | |
|---|---|
| Composition of Backing Layer: | |
| Gelatin | 170 mg/m² |
| Sodium Dodecylbenzenesulfonate | 32 mg/m² |
| Sodium Dihexyl-α-sulfosuccinate | 35 mg/m² |
| $SnO_2$/Sb (9/1, by weight; mean grain size 0.25 μm) | 318 mg/m² |
| Composition of Backing Layer-Protecting Layer: | |
| Gelatin | 2.7 g/m² |
| Silicon Dioxide Matting Agent (mean grain size 3.5 μm) | 26 mg/m² |
| Sodium Dihexyl-α-sulfosuccinate | 20 mg/m² |
| Sodium Dodecylbenzenesulfonate | 67 mg/m² |
| $C_8F_{17}SO_2N(C_3H_7)-(CH_2CH_2O)_n-(CH_2)_4-SO_3Li$ | 5 mg/m² |

-continued

Dye (A):

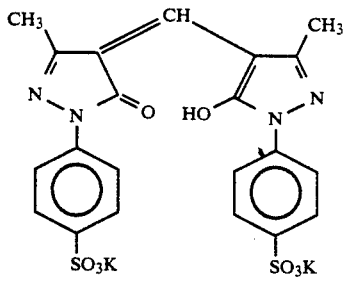

190 mg/m²

Dye (B):

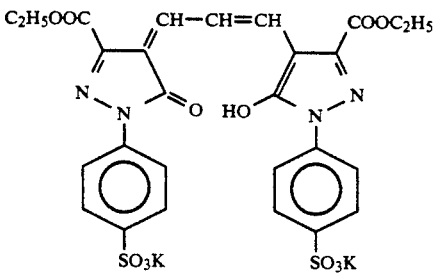

32 mg/m²

Dye (C):

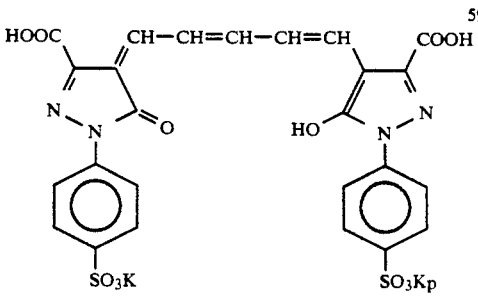

59 mg/m²

| | |
|---|---|
| Ethyl Acrylate Latex (mean grain size 0.05 μm) | 260 mg/m² |
| 1,3-Divinylsulfonyl-2-propanol | 149 mg/m² |

Evaluation of Photographic Properties

Photographic material samples thus prepared were wedgewise exposed with P-617 DQ Model Printer (quartz, manufactured by Dai-Nippon Screen Co.). These were then developed with a developer (LD-835, product by Fuji Photo Film Co., Ltd.) at 38° C. for 20 seconds, fixed, rinsed in water and dried, using an automatic developing machine of FG-800RA Model. The processed samples were examined with respect to the following matters:

(1) Relative Sensitivity: This is represented by a reciprocal of the exposure of giving a density of 1.5, based on the sensitivity of Sample (1) of being 100.

(2) Gamma value (γ): This is represented by the following formula:

$$(3.0-0.3)/[\log(\text{exposure of giving density } 0.3)-\log(\text{exposure of giving density } 3.0)]$$

In addition, the samples were also evaluated with respect to the quality of super-imposed letter image formed thereon by way of 5-rank evaluation, by image-wise exposing them through the original of FIG. 1.

Precisely, for the 5-rank super-imposed letter image evaluation, the photographic material sample was properly exposed through the original of FIG. 1 so that 50% of the dot area of the original could be 50% of the dot area of the reproduced image on the sample by contact dot-to-dot work. The rank "5" in the evaluation indicates that 30 μm-letters were well reproduced under the condition and the super-imposed letter image quality was excellent. The rank "1" therein indicates that only letters of 150 μm or more were reproduced under the same condition and the super-imposed letter image quality was bad. The other ranking of from "4" to "2" between the ranks "5" and "1" was conducted by functional evaluation. The ranks of "3" or more indicate the practical level.

As is obvious from the results in Table 3 below, the samples of the present invention had an excellent super-imposed letter image quality without lowering the sensitivity and gradation and they were verified to be well applicable to dot-to-dot work stage.

TABLE 3

| No. | Emulsion Used | Dye | Amount of Dye Added(*) (mg/m²) | Relative Sensitivity | γ | Super-Imposed Letter Image Quality | |
|---|---|---|---|---|---|---|---|
| 1 | A | Comparative Dye (1) | 50 | 100 | 7.5 | 1.5 | |
| 2 | " | I-2 | 80 | 102 | 8.0 | 3.5 | Samples of the invention |
| 3 | " | I-3 | " | 99 | 7.9 | 3.5 | |
| 4 | " | I-15 | " | 101 | 7.8 | 3 | |
| 5 | " | I-21 | " | 98 | 7.7 | 3.5 | |
| 6 | B | Comparative Dye (1) | 70 | 100 | 5.5 | 1.5 | |
| 7 | " | I-2 | 80 | 100 | 6.1 | 3 | Samples of the invention |
| 8 | " | I-3 | " | 98 | 5.7 | 3.5 | |
| 9 | " | I-15 | " | 101 | 5.8 | 3 | |
| 10 | " | I-21 | " | 99 | 5.8 | 3.5 | |

(*)Dye was added in the form of a dispersion of fine grains, which was prepared as mentioned below. However, the comparative dye in the comparative samples was uniformly dissolved during the preparation of dispersion.

Preparation of Dispersion of Fine Grains of Dye

A 6.7% solution comprising 434 ml of water and 53 g of Triton X-200 (surfactant TX-200, product by Rohn & Haas Co.) was put in a 1.5-liter bottle with a screw stopper. To this were added 20 g of a dye and 800 ml of zirconium oxide beads (having a diameter of 2 mm). The content was then milled for 4 days. Next, 160 g of an aqueous 12.5% gelatin solution was added thereto. After defoamed, the beads were removed by filtration. Finally, a dispersion of fine grains of the dye was obtained.

Comparative Dye (1) used above is one having the following structural formula:

Comparative Dye (1):

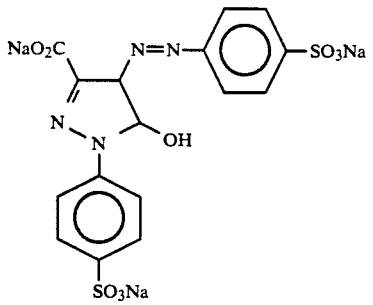

EXAMPLE 4

Preparation of Emulsion (C):

Formation of nuclei was effected by adding an aqueous solution of 2.9M silver nitrate and an aqueous halide solution containing 3.0M sodium chloride and $2.0\times10^{-5}$M ammonium hexachlororhodate(III) to an aqueous gelatin solution containing sodium chloride and having a pH value of 2.0, with stirring at 40° C. over a period of 4 minutes under a constant potential of 85 mV. After one minute, an aqueous solution of 2.9M silver nitrate and an aqueous halide solution containing 3.0M sodium chloride were added thereto at 40° C. at a rate of a half of that employed in the previous formation of nuclei, over a period of 8 minutes under a constant potential of 85 mV. Next, the resulting emulsion was washed with water by an ordinary flocculation method, gelatin was added thereto, and it was adjusted to have a pH value of 5.7 and a pAg value of 7.4. As a stabilizer, $8\times10^{-3}$ mol per mol of silver of 5,6-trimethylene-7-hydroxy-s-triazolo(2,3-a)pyrimidine and $1.5\times10^{-3}$ mol per mol of silver of 6-methyl-4-hydroxy-1,3,3a,7-tetrazaindene were added thereto. The grains thus formed were cubic silver chloride grains containing Rh in an amount of $3.0\times10^{-6}$ mol per mol of silver and having a mean grain size of 0.16 μm. The fluctuation coefficient was 12%.

To the emulsion was added the following hydrazine compound (Hz) in an amount of $4\times10^{-4}$ mol per mol of silver.

Hz:

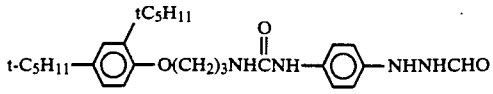

Next, polyethyl acrylate latex was added thereto in an amount of 30% by weight as a solid content thereof to gelatin, and a hardening agent of 1,3-divinylsulfonyl-2 propanol was added thereto. The resulting composition was then coated on a polyethylene terephthalate film in an amount of 4.0 g/m$^2$ as silver. An overcoat layer containing an yellow dye (as indicated in Table 4 below) for improving safelight safety was coated over the emulsion layer, whereupon the dye was added in the form of a dispersion of fine grains thereof as prepared in the same manner as in Table 3 in Example 3. However, in Sample No. 1 (comparative sample) containing Comparative Dye (2), the dye was added in the form of a uniform solution thereof. Samples Nos. 2 to 5 are the samples of the present invention. The support had the same backing layer as in Example 3.

Evaluation of Photographic Properties

The thus prepared samples were wedgewise exposed through the original of FIG. 1 in the same way as in Example 3, using P-627 FM Model Printer (manufactured by Dai Nippon Screen Co.). The samples were then developed with a developer GR-D1 (product by Fuji Photo Film Co., Ltd.) at 38° C. for 20 seconds and then fixed, rinsed in water and dried, using an automatic developing machine of FG 660 Model. As a light source filter was used a filter of SC-41 Model (manufactured by Fuji Photo Film Co., Ltd.).

The thus processed samples were evaluated with respect to the relative sensitivity, the gamma value (γ) and the super-imposed letter image quality, in the same way as in Example 3.

The results obtained are shown in Table 4 below. As is noted therefrom, the samples of the present invention all had an excellent super-imposed letter image quality, over the comparative sample. Additionally, the samples of the present invention were quite free from stains to be caused by color retention of the dye as remained therein, like the comparative sample.

TABLE 4

| No. | Emulsion Used | Dye Used | Amount of Dye Added (mg/m$^2$) | Relative Sensitivity | γ | Super-Imposed Letter Image Quality |
|---|---|---|---|---|---|---|
| 1 | C | Comparative Dye (2) | 20 | 100 | 13.0 | 3.5 |
| 2 | " | I-2 | 80 | 100 | 13.5 | 5 |
| 3 | " | I-3 | " | 101 | 13.0 | 5 |
| 4 | " | I-15 | " | 98 | 13.5 | 5 |

TABLE 4-continued

| No. | Emulsion Used | Dye Used | Amount of Dye Added ($mg/m^2$) | Relative Sensitivity | $\gamma$ | Super-Imposed Letter Image Quality |
|---|---|---|---|---|---|---|
| 5 | " | I-21 | " | 99 | 13.0 | 4.5 |

Comparative Dye (2):

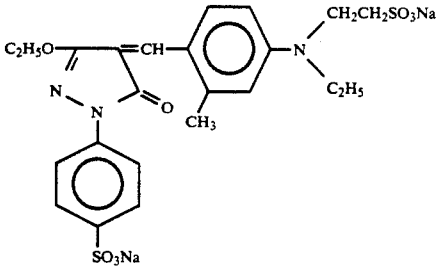

EXAMPLE 5

Support

A biaxially stretched polyethylene terephthalate film having a thickness of 100 μm was surface-treated by corona-discharging, and the following subbing layers were coated thereon with a wire bar coater and dried at 170° C. for one minute.

| | |
|---|---|
| First Subbing Layer: | |
| Butadiene-Styrene Copolymer Latex (butadiene/styrene = 31/69, by weight) | 0.16 $g/m^2$ |
| 2,4-Dichloro-6-hydroxy-s-triazine Sodium Salt | 4.2 $g/m^2$ |

Second Subbing Layer

Over the first subbing layer was coated a second subbing layer comprising the following components, and this was dried at 175° C. for one minute.

| | |
|---|---|
| Gelatin | 0.08 $g/m^2$ |
| $C_{12}H_{25}O(CH_2CH_2O)_{10}H$ | 7.5 $mg/m^2$ |

Preparation of Emulsion (I):

| | |
|---|---|
| Solution (I): 75° C. | |
| Inactive Gelatin | 24 g |
| Distilled Water | 900 ml |
| KBr | 4 g |
| 10% Aqueous Phosphoric Acid Solution | 2 ml |
| Sodium Benzenesulfinate | $5 \times 10^{-2}$ mol |
| 1,2-Bis(2-hydroxyethylthio)ethane | $2.5 \times 10^{-3}$ mol |
| Solution (II): 35° C. | |
| Silver Nitrate | 170 g |
| Distilled Water to make | 1000 ml |
| Solution (III): 35° C. | |

-continued

| | |
|---|---|
| KBr | 230 g |
| Distilled Water to make | 1000 ml |
| Solution (IV): room temperature | |
| Potassium Hexacyanoferrate(II) | 3.0 g |
| Distilled Water to make | 1000 ml |

Solution (II) and Solution (III) were added to Solution (I) at the same time over a period of 5 minutes, whereupon addition of Solution (II) and Solution (III) were stopped at the time when octahedral grains having a mean grain size of 0.10 μm were formed, and 115 mg per mol of silver of sodium thiosulfate and 115 mg per mol of silver of chloroauric acid tetrahydrate were added thereto to subsequently conduct chemical sensitization of the emulsion grains at 75° C. for 60 minutes. Solution (II) and Solution (III) were again simultaneously added to the thus formed and chemical-sensitized core grains. Five minutes after the second addition of Solution (II), Solution (IV) was added to the emulsion over a period of 5 minutes, whereupon the addition speed of Solution (III) was so adjusted that the mixture system could have a pAg value of 7.50. Addition of Solution (II) was completed at 75° C. in 40 minutes. Accordingly, an emulsion of cubic core/shell grains having a mean grain size of 0.28 μm was finally obtained. The emulsion was then washed with water and desalted by an ordinary flocculation method, and it was thereafter dispersed in an aqueous solution containing 90 g of inactive gelatin. To the emulsion were added 34 mg per mol of silver of sodium thiosulfate and 34 mg per mol of silver of chloroauric acid tetrahydrate, and the emulsion was adjusted to have a pH value of 8.9 and a pAg value of 7.0 (40° C.). Accordingly, the emulsion was chemically sensitized at 75° C. for 60 minutes.

Formation of Anti-halation Layer (AH Layer) (5-a):

| | |
|---|---|
| Gelatin | 1.7 $g/m^2$ |
| Compound of the following formula: | 167.8 $mg/m^2$ |

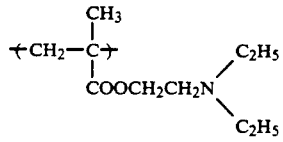

Dye (A) of the following formula:

-continued

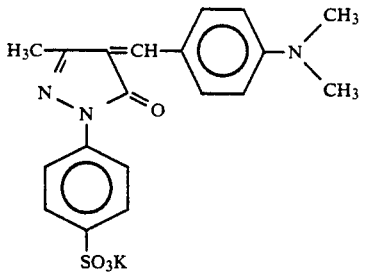

72.4 mg/m²

Dye (B) of the following formula:

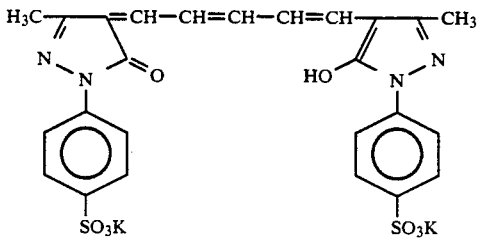

68.5 mg/m²

Dye (C) of the following formula:

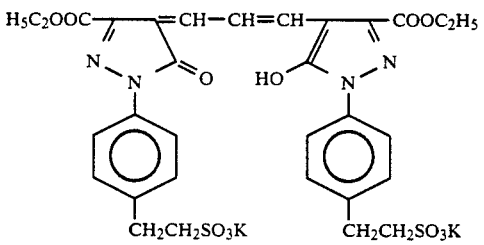

68.5 mg/m²

Formation of Anti-halation Layer (AH Layer) (5-b):

| | |
|---|---|
| Gelatin | 1.7 g/m² |
| Dye (I-3) | 90.6 mg/m² |
| Dye (II-1) | 140 mg/m² |
| 1.3-Bis(vinylsufonyl)-2-propanol | 59.5 mg/m² |

Preparation of Dispersion of Dye (I-3) and Dispersion of Dye (II-1)

Water (434 ml) and 6.7% solution of a surfactant Triton X-200® (TX-200®; product by Rohm & Haas Co.) (53 g) were put in a 1.5-liter bottle with a screw stopper. 20 g of a dye (I-3 or II-1) and 800 ml of zirconium oxide (ZrO) beads (diameter: 2 mm) were added thereto, and the bottom was firmly closed with the stopper. This was put in a mill and the content was milled for 4 days.

The thus milled content was added to an aqueous 12.5% gelatin solution (160 g) and set in a roll mill to decrease the foams. The resulting mixture was filtered to remove ZrO beads.

Next, grains having a grain size of 1 μm or more were substantially removed.

Formation of Anti-halation Layer (AH Layer) (5-c)

This was same as AH layer (5-b), except that the dyes were replaced by (I-2) (94.6 mg/m²) and (II-4) (150 mg/m²).

Formation of Anti-halation Layer (AH Layer) (5-d)

This was same as AH layer (5-b), except that the dyes were replaced by (I-21) (100 mg/m²) and (II-2) (140 (mg/m²).

Formation of Anti-halation Layer (AH Layer) (5-e)

This was same as AH layer (5-b), except that the dyes were replaced by the following Comparative Dye (D) and (II-1) (140 mg/m²).

Comparative Dye (D):

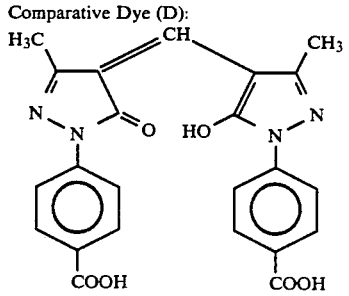

Combination of Comparative Dye (D) and Dye (II-1) is described in JP-A-52-92716.

The anti-halation layers (5-a) to (5-e) had an absorbance in the visible ran range of from 400 to 700 nm of being 0.7 on average.

TABLE 5-1-continued

| Sample | AH Layer | Dyes in AH Layer |
|---|---|---|
| 5-F (comparative sample) | 1-f | No |

| Formation of Anti-halation Layer (AH layer) (5-f): | |
|---|---|
| Gelatin | 1.7 g/m$^2$ |
| 1,3-Bis(vinylsulfonyl)-2-propanol | 59.5 mg/m$^2$ |
| Emulsion Layer: | |
| Silver Halide Emulsion | 1700 mg/m$^2$ as Ag |
| Gelatin | 1.6 g/m$^2$ |
| Sensitizing Dye (Compound (a)) | 23.8 mg/m$^2$ |
| Nucleating Agent (Compound (b)) | 0.0394 mg/m$^2$ |
| 5-Methylbenzotriazole | 4.1 mg/m$^2$ |
| Sodium Dodecylbenzenesulfonate | 5 mg/m$^2$ |
| 1,3-Bis(vinylsulfonyl)-2-propanol | 56 mg/m$^2$ |
| Sodium Polystyrenesulfonate | 35 mg/m$^2$ |
| Wetting Agent (Compound (c)) | 15 mg/m$^2$ |

Sensitizing Agent (Compound (a)):

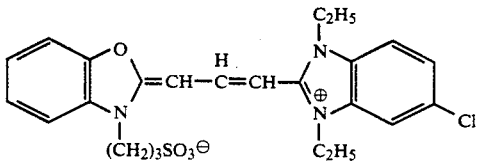

Nucleating Agent (Compound (b)):

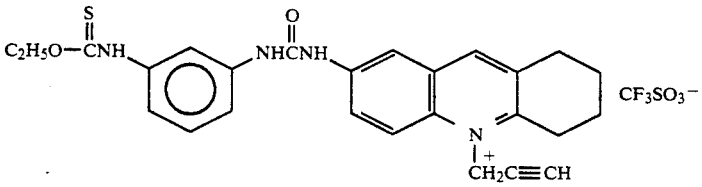

Wetting Agent (Compound (c)):

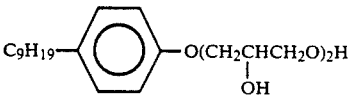

| Protective Layer: | |
|---|---|
| Inactive Gelatin | 700 mg/m$^2$ |
| Colloidal Silica | 249 mg/m$^2$ |
| Liquid Paraffin | 60 mg/m$^2$ |
| Strontium Barium Sulfate (mean grain size 1.5 μm) | 32 mg/m$^2$ |
| Proxel | 4.3 mg/m$^2$ |
| N-perfluorooctanesulfonyl-N-propylglycine Potassium Salt | 5.0 mg/m$^2$ |
| 1,3-Bis(vinylsulfonyl)-2-propanol | 36 mg/m$^2$ |

On the above-mentioned support, the anti-halation layer (AH layer), emulsion layer and protective layer were coated and dried in this order as indicated in Table 5-1 below. Accordingly, photographic material samples (5-A) to (5-F) were prepared.

TABLE 5-1

| Sample | AH Layer | Dyes in AH Layer |
|---|---|---|
| 5-A (comparative sample) | 1-a | (A), (B), (C); All mordanted |
| 5-B (sample of the invention) | 1-b | (I-3), (II-1); Fine solid dispersions |
| 5-C (sample of the invention) | 1-c | (I-2), (II-4); Fine solid dispersions |
| 5-D (sample of the invention) | 1-d | (I-25), (II-2); Fine solid dispersions |
| 5-E (comparative sample | 1-e | (D), (II-1); Fine solid dispersions |

Evaluation of Photographic Properties

Each of the samples prepared above was imagewise exposed with MARK-II Model Xenon Flash Lamp Photometer (manufactured by E.G. & G. of USA) through a continuous density of wedge for $10^{-3}$ second under a safelight condition, whereupon the light was irradiated to the emulsion-coated surface.

The exposed samples were processed with an automatic developing machine, using a conventional microfilm-processing solution (FR-537 Developer: product by FR Chemicals of USA) under the conditions mentioned below.

TABLE 5-2

| | Step | Processing Solution | Temp. | Time |
|---|---|---|---|---|
| 1. | Development | FR-537 (1:3) | 44° C. | 9 sec |
| 2. | Rinsing | Flowing Water | " | " |
| 3. | Fixation | FR-535 (1:3) | " | " |
| 4. | Rinsing | Spray | " | " |
| 5 | Drying | Hot Air | 50° C. | " |

Measurement of Sharpness (MTF)

Sharpness was measured on the basis of MTF. Precisely, each photographic material sample was exposed with a white light for 1/100 second through an MTF wedge and then developing with the above-mentioned automatic developing machine.

For the measurement, an aperture of $400\times2\ \mu m^2$ was used. Using the MTF value of 20 cycles/mm as the space frequency, the part having an optical density of 1.0 was evaluated.

Evaluation of Color Retention

Each of Samples (5-A) to (5-F) was, without being exposed, processed by the same process as mentioned above. After the process, the color retention, if any, of each of the processed samples was checked by functional evaluation. The results obtained are shown in Table 5-3 below.

In the functional color retention test, the results were ranked by the following three ranks:

A: No color retention was recognized.

B: Some color retention was recognized, but it yields no problem for practical use.

C: Noticeable color retention was recognized, and it causes some problem in practical use.

Storage Stability of Dyes

The reflection spectrum of each of the non-exposed photographic material samples (Samples (5-A) to (5-F)) to a visible ray ranging from 400 to 700 nm was measured under an infrared light. Next, each of the samples (Samples (5-A) to (5-F)) was put in a field camera and subjected to a forced aging test under the condition of 50° C. and 80% RH for 3 days. The reflection spectrum of each of the thus aged samples to the same visible ray range was measured.

From the data measured, the ratio of the absorbance, before and after the test, at a wavelength of 450 nm, 550 nm or 650 nm was obtained on the basis of the following formula:

Ration of Absorbance = [(absorbance after the forced aging test)/(absorbance before the forced aging test)] × 100 (%)

Suitability of Dye to Processor

Each of the non-exposed samples (Samples (5-A) to (5-F)) having an area of 8 $m^2$ was processed in the same way as that mentioned in Table 5-2 above, using the same developer. After each sample was processed, the degree of coloration of the used developer was determined with respect to the transmission absorption spectrum thereof. The results obtained are shown in Table 5-3 below.

Evaluation of the suitability of the dye used to the processor (developer) was effected on the basis of the following three ranks.

A: The used developer did not almost colored. It had almost the same absorption as that of the original one.

B: The used developer colored slightly, but the coloration did not cause any problem in practical use.

C: The used developer colored noticeably, and the coloration causes some problem in practical use.

TABLE 5-3

| Sample | AH Layer | MTF | Color Retention | Ratio of Absorbance 450 nm (%) | 550 nm (%) | 650 nm (%) | Suitability to Developer |
|---|---|---|---|---|---|---|---|
| 5-A (comparative sample) | 5-(a) | 0.97 | B | 46.4 | 78.7 | 51.2 | B |
| 5-B (sample of the invention) | 5-(b) | 1.0 | A | 100 | 99.8 | 118 | A |
| 5-C (sample of the invention) | 5-(c) | 1.0 | A | 100 | 98.8 | 100 | A |
| 5-D (sample of the invention) | 5-(d) | 1.0 | A | 100 | 99.5 | 101 | A |
| 5-E (comparative sample) | 5-(e) | 0.99 | B | 93.0 | 92.5 | 123 | C |
| 5-F (comparative sample) | 5-(f) | 0.80 | A | (100) | (100) | (100) | A |

As Sample (5-F) contained no dye, the reflection spectrum thereof before and after the forced aging test did not vary. The data of Sample (5-F) were parenthesized.

The samples (Samples (5-A) to (5-E)) had the same sensitivity with no problem in practical use.

As is noted from the results in Table 5-3 above, the decoloration of the samples each containing the combination of the dyes of the invention was rapid in processing them, with giving no color retention in the processed samples. Additionally, the anti-halation layer (having a light absorption in the visible ray range) of each of the samples of the invention displayed an excellent anti-halation effect, which was not lowered even after storage under the forced aging condition.

The comparative sample (Sample (5-E)) is one which is considered to be the best one obtainable by the current technique. As compared with this Sample (5-E), all the samples of the present invention (Samples (5-B), (5-C), (5-D)) surprisingly had better storage stability, higher decolorability (with less color retention in the processed samples) and better suitability to developer (with no contamination of the used developer), in addition to excellent photographic properties.

EXAMPLE 6

Preparation of Sample No. 601

Plural layers each having the composition mentioned below were formed on a cellulose triacetate film support as subbed and having a thickness of 127 μm, to prepare a multi-layer color photographic material sample (Sample No. 601). The number for each constitutive component indicates the amount added per $m^2$. The effect of each component is not limited to only one as indicated.

| | |
|---|---|
| First Layer: Anti-halation Layer | |
| Black Colloidal Silver | 0.25 g |
| Gelatin | 1.9 g |
| Ultraviolet Absorbent U-1 | 0.04 g |
| Ultraviolet Absorbent U-2 | 0.1 g |
| Ultraviolet Absorbent U-3 | 0.1 g |
| Ultraviolet Absorbent U-4 | 0.1 g |
| Ultraviolet Absorbent U-6 | 0.1 g |
| High-boiling Point Organic Solvent Oil-1 | 0.1 g |
| Second Layer: Interlayer | |
| Gelatin | 0.40 g |
| Compound Cpd-D | 10 mg |
| High boiling Point Organic Solvent Oil-3 | 0.1 g |
| Dye D-4 | 0.4 mg |
| Third Layer: Interlayer | |
| Emulsion of Fine Silver Iodobromide Grains whose surfaces and cores were fogged (mean grain size 0.06 μm, fluctuation coefficient 18%, AgI content 1 mol %) | 0.05 g as Ag |
| Gelatin | 0.4 g |
| Fourth Layer: Low-sensitivity Red-sensitive Emulsion Layer | |
| Emulsion A | 0.2 g as Ag |
| Emulsion B | 0.3 g as Ag |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High-boiling Point Organic Solvent Oil-2 | 0.1 g |
| Fifth Layer: Middle-sensitivity Red-sensitive Emulsion Layer | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High boiling Point Organic Solvent Oil-2 | 0.1 g |
| Sixth Layer: High-sensitivity Red-sensitive Emulsion Layer | |
| Emulsion D | 0.4 g as Ag |
| Gelatin | 1.1 g |
| Coupler C-1 | 0.3 g |
| Coupler C-3 | 0.7 g |
| Additive P-1 | 0.1 g |
| Seventh Layer: Interlayer | |
| Gelatin | 0.6 g |
| Additive M-1 | 0.3 g |
| Color Mixing Preventing Agent Cpd-K | 2.6 mg |
| Ultraviolet Absorbent U-1 | 0.1 g |
| Ultraviolet Absorbent U-6 | 0.1 g |
| Dye D-1 | 0.02 g |
| Eighth Layer: Interlayer | |
| Emulsion of Fine Silver Iodobromide Grains whose surfaces and cores were fogged (mean grain size 0.06 μm, fluctuation coefficient 16%, AgI content 0.3 mol %) | 0.02 g as Ag |
| Gelatin | 1.0 g |
| Additive P-1 | 0.2 g |
| Color Mixing Preventing Agent Cpd-J | 0.1 g |
| Color Mixing Preventing Agent Cpd-A | 0.1 g |
| Ninth Layer: Low-sensitivity Green sensitive Emulsion Layer | |
| Emulsion E | 0.3 g as Ag |
| Emulsion F | 0.1 g as Ag |

-continued

| | |
|---|---|
| Emulsion G | 0.1 g as Ag |
| Gelatin | 0.5 g |
| Coupler C-7 | 0.05 g |
| Coupler C-8 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High-boiling Point Organic Solvent Oil-1 | 0.1 g |
| High-boiling Point Organic Solvent Oil-2 | 0.1 g |
| Tenth Layer: Middle-sensitivity Green-sensitive Emulsion Layer | |
| Emulsion G | 0.3 g as Ag |
| Emulsion H | 0.1 g as Ag |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High-boiling Point Organic Solvent Oil-2 | 0.01 g |
| Eleventh Layer: High-sensitivity Green-sensitive Emulsion Layer | |
| Emulsion I | 0.5 g as Ag |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-boiling Point Organic Solvent Oil-1 | 0.02 g |
| High-boiling Point Organic Solvent Oil-2 | 0.02 g |
| Twelfth Layer: Interlayer | |
| Gelatin | 0.6 g |
| Dye D-1 | 0.1 g |
| Dye D-2 | 0.05 g |
| Dye D-3 | 0.07 g |
| Thirteenth Layer: Yellow Filter Layer | |
| Yellow Colloidal Silver | 0.1 g as Ag |
| Gelatin | 1.1 g |
| Color Mixing Preventing Agent Cpd-A | 0.01 g |
| High-boiling Point Organic Solvent Oil-1 | 0.01 g |
| Fourteenth Layer: Interlayer | |
| Gelatin | 0.6 g |
| Fifteenth Layer: Low-sensitivity Blue-sensitive Emulsion Layer | |
| Emulsion J | 0.4 g as Ag |
| Emulsion K | 0.1 g as Ag |
| Emulsion L | 0.1 g as Ag |
| Gelatin | 0.8 g |
| Coupler C-5 | 0.6 g |
| Sixteenth Layer: Middle-sensitivity Blue-sensitive Emulsion Layer | |
| Emulsion L | 0.1 g as Ag |
| Emulsion M | 0.4 g as Ag |
| Gelatin | 0.9 g |
| Coupler C-5 | 0.3 g |
| Coupler C-6 | 0.3 g |
| Seventeenth Layer: High-sensitivity Blue-sensitive Emulsion Layer | |
| Emulsion N | 0.4 g as Ag |
| Gelatin | 1.2 g |
| Coupler C-6 | 0.7 g |
| Eighteenth Layer: First Protective Layer | |
| Gelatin | 0.7 g |
| Ultraviolet Absorbent U-1 | 0.04 g |
| Ultraviolet Absorbent U-2 | 0.01 g |
| Ultraviolet Absorbent U-3 | 0.03 g |

-continued

| | |
|---|---|
| Ultraviolet Absorbent U-4 | 0.03 g |
| Ultraviolet Absorbent U-5 | 0.05 g |
| Ultraviolet Absorbent U-6 | 0.05 g |
| High-boiling Point Organic Solvent Oil-1 | 0.02 g |
| Formalin Scavenger Cpd-C | 0.2 g |
| Formalin Scavenger Cpd-I | 0.4 g |
| Dye D-3 | 0.05 g |
| Nineteenth Layer: Second Protective Layer | |
| Colloidal Silver | 0.1 mg as Ag |
| Emulsion of Fine Silver Iodobromide Grains (mean grain size 0.06 μm, AgI content 1 mol %) | 0.1 g as Ag |
| Gelatin | 0.4 g as Ag |
| Twentieth Layer: Third Protective Layer | |
| Gelatin | 0.4 g |
| Polymethyl Methacrylate (mean grain size 1.5 μm) | 0.1 g |
| Copolymer of Methyl Methacrylate and Acrylic Acid (4/6) (mean grain size 1.5 μm) | 0.1 g |
| Silicone Oil | 0.03 g |
| Surfactant W-1 | 3.0 mg |
| Surfactant W-2 | 0.03 g |

All the emulsion layers contained additives (F-1) to (F-8) in addition to the above-mentioned components. Further, each layer contained a gelatin-hardening agent (H-1) and surfactants (as coating and emulsifying aids) (W-3) and (W-4), in addition to the above-mentioned components. Additionally, phenol, 1,2-benzisothiazolin-3-one, 2-phenoxyethanol and phenethyl alcohol were added as bactericidal and fungicidal agents.

Silver iodobromide emulsions as used in preparing Sample No. 601 were as follows:

| Emulsion | mean grain size (μm) | fluctuation coefficient (%) | AgI content (%) |
|---|---|---|---|
| A Monodisperse 14-hedral grains | 0.25 | 16 | 3.7 |
| B Monodisperse cubic internal latent image-type grains | 0.30 | 10 | 3.3 |
| C Monodisperse 14-hedral grains | 0.30 | 18 | 5.0 |
| D Polydisperse twin-lane grains | 0.60 | 25 | 2.0 |
| E Monodisperse cubic grains | 0.17 | 17 | 4.0 |
| F Monodisperse cubic grains | 0.20 | 16 | 4.0 |
| G Monodisperse cubic internal latent image-type grains | 0.25 | 11 | 3.5 |
| H Monodisperse cubic internal latent image-type grains | 0.30 | 9 | 3.5 |
| I Polydisperse tabular grains (mean aspect ratio 4.0) | 0.80 | 28 | 1.5 |
| J Monodisperse 14-hedral grains | 0.30 | 18 | 4.0 |
| K Monodisperse 14-hedral grains | 0.37 | 17 | 4.0 |
| L Monodisperse cubic internal latent image-type grains | 0.46 | 14 | 3.5 |
| M Monodisperse cubic grains | 0.55 | 13 | 4.0 |
| N Polydisperse tabular grains (mean aspect ratio 7.0) | 1.00 | 33 | 1.3 |

Emulsions A to N were color-sensitized as follows:

| Emulsion | Sensitizing Dye(s) Added | Amount (g) Added, per mol of Silver halide | Time of Adding Sensitizing Dye |
|---|---|---|---|
| A | S-1 | 0.025 | Just after chemical sensitization |
| | S-2 | 0.25 | Just after chemical sensitization |
| B | S-1 | 0.01 | Just after completion of formation of grains |
| | S-2 | 0.25 | Just after completion of formation of grains |
| C | S-1 | 0.02 | Just after chemical sensitization |
| | S-2 | 0.25 | Just after chemical sensitization |
| D | S-1 | 0.01 | Just after chemical sensitization |
| | S-2 | 0.10 | Just after chemical sensitization |
| | S-7 | 0.01 | Just after chemical sensitization |
| E | S-3 | 0.5 | Just after chemical sensitization |
| | S-4 | 0.1 | Just after chemical sensitization |
| F | S-3 | 0.3 | Just after chemical sensitization |
| | S-4 | 0.1 | Just after chemical sensitization |
| G | S-3 | 0.25 | Just after completion of formation of grains |
| | S-4 | 0.08 | Just after completion of formation of grains |
| H | S-3 | 0.2 | During formation of grains |
| | S-4 | 0.06 | During formation of grains |
| I | S-3 | 0.3 | Just before beginning of chemical sensitization |
| | S-4 | 0.07 | Just before beginning of chemical sensitization |
| | S-8 | 0.1 | Just before beginning of chemical sensitization |
| J | S-6 | 0.2 | During formation of grains |
| | S-5 | 0.05 | During formation of grains |
| K | S-6 | 0.2 | During formation of grains |
| | S-5 | 0.05 | During formation of grains |
| L | S-6 | 0.22 | Just after completion of formation of grains |
| | S-5 | 0.06 | Just after completion of formation of grains |
| M | S-6 | 0.15 | Just after chemical sensitization |
| | S-5 | 0.04 | Just after chemical sensitization |
| N | S-6 | 0.22 | Just after completion of formation of grains |
| | S-5 | 0.06 | Just after completion of formation of grains |

Compounds used above are mentioned below.

C-1
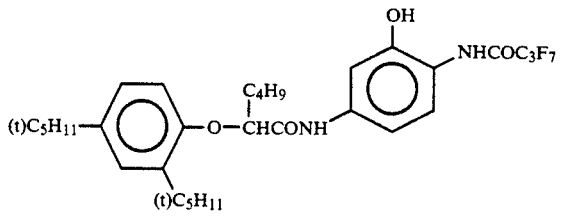
C-2
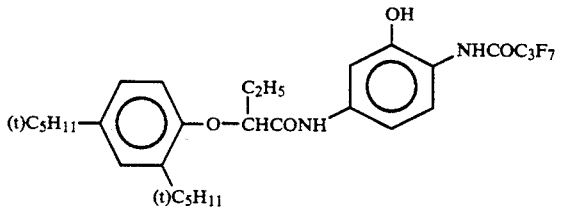
C-3
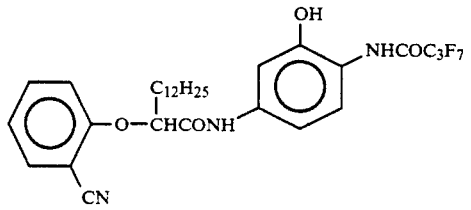
C-4
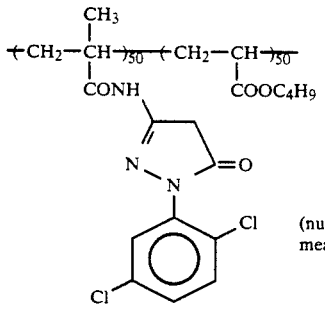
(number: % by weight)
mean molecular weight: ca. 25,000
C-5
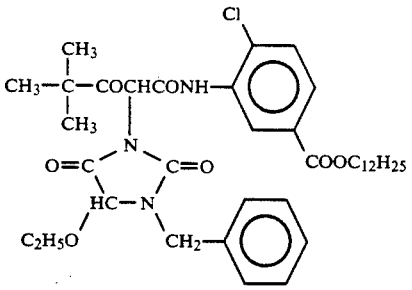
C-6
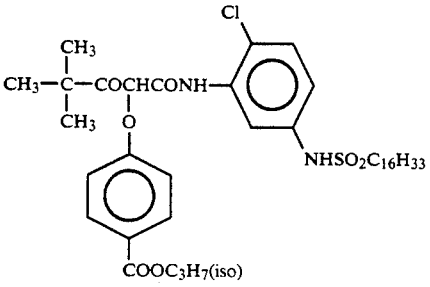

-continued
C-7
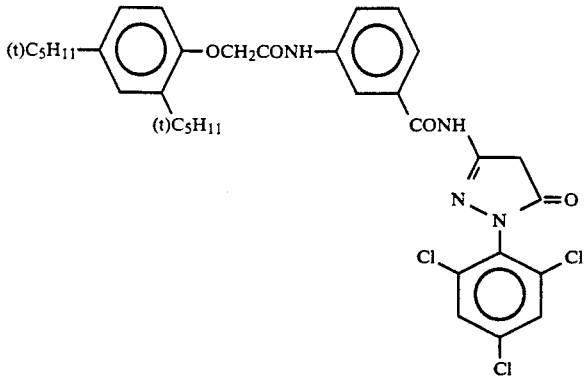
C-8
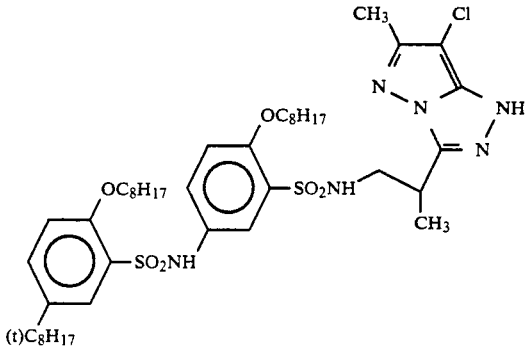
C-9
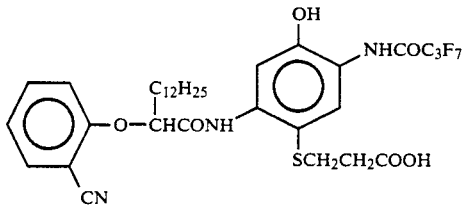
Dibutyl phthalate — Oil-1
Tricresyl phosphate — Oil-2
Oil-3
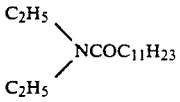
Cpd-A
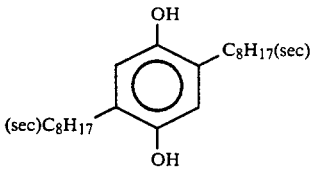
Cpd-B
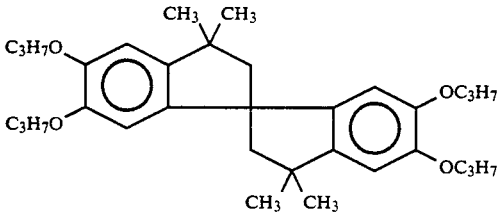
Cpd-C
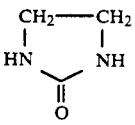

-continued
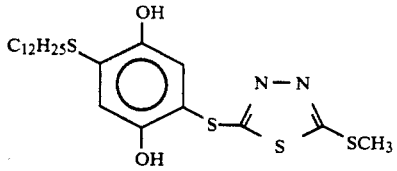
Cpd-D
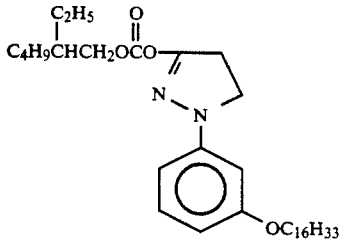
Cpd-E
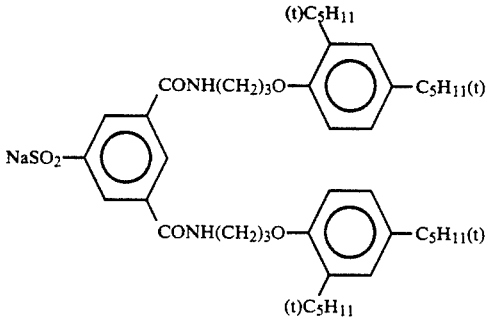
Cpd-F
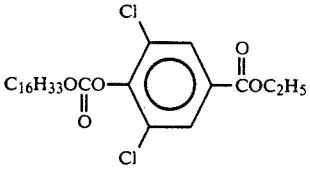
Cpd-G
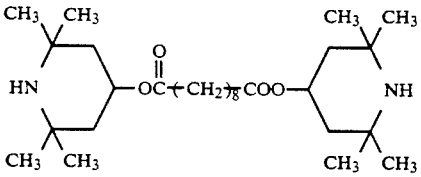
Cpd-H
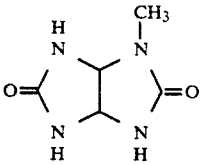
Cpd-I
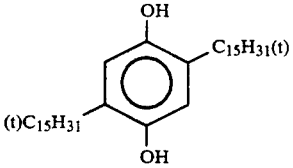
Cpd-J
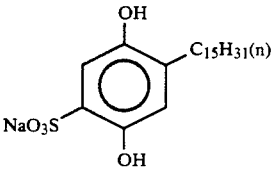
Cpd-K -continued
U-1
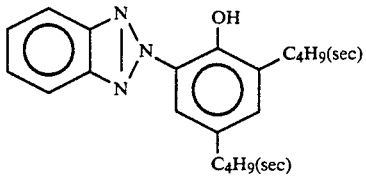
U-2
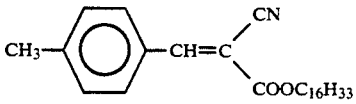
U-3
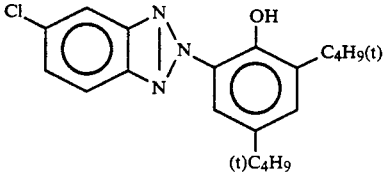
U-4
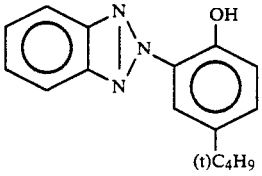
U-5
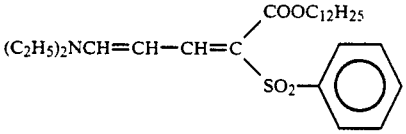
U-6
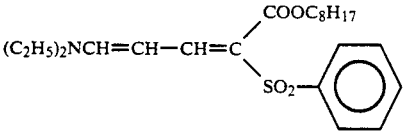
S-1
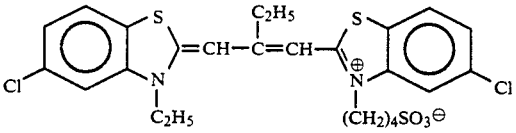
S-2
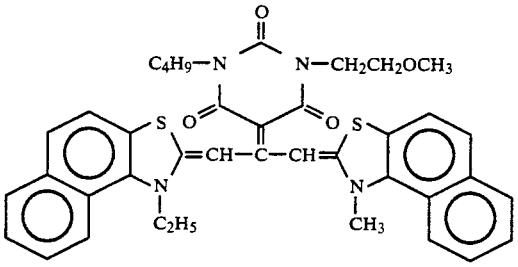
S-3
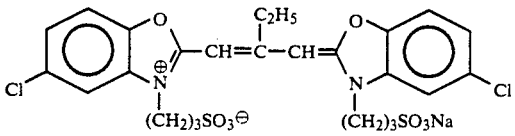

-continued
S-4
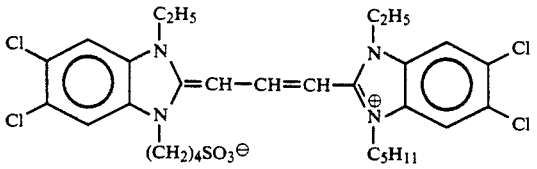
S-5
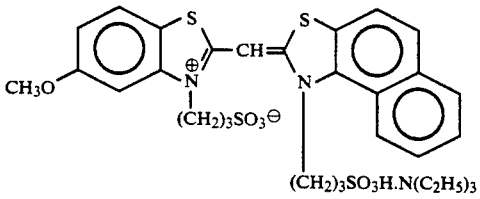
S-6
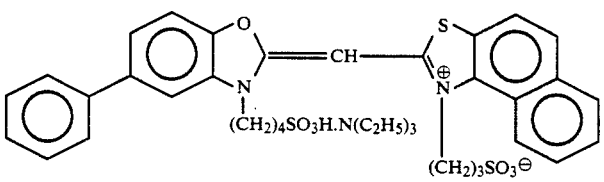
S-7
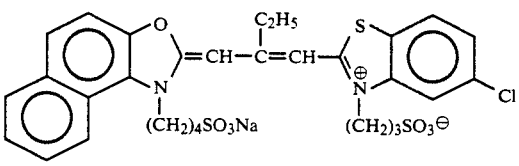
S-8
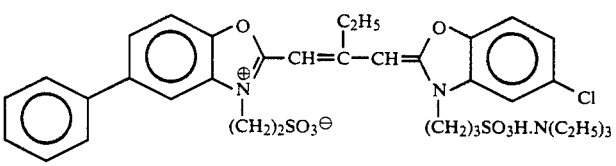
D-1
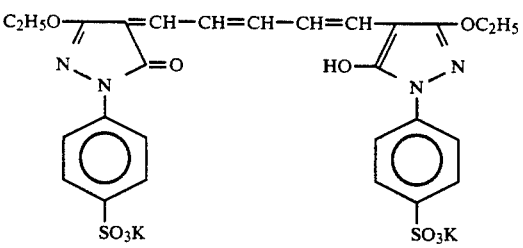
D-2
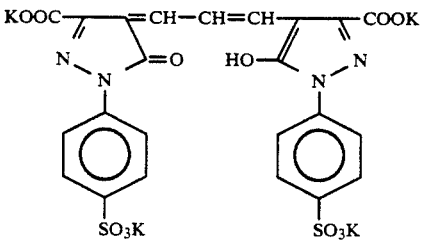

-continued
D-3
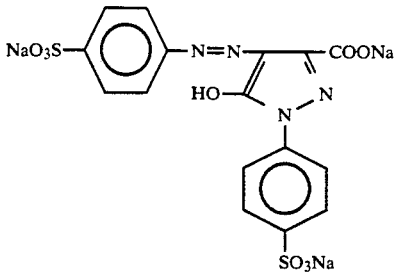
D-4
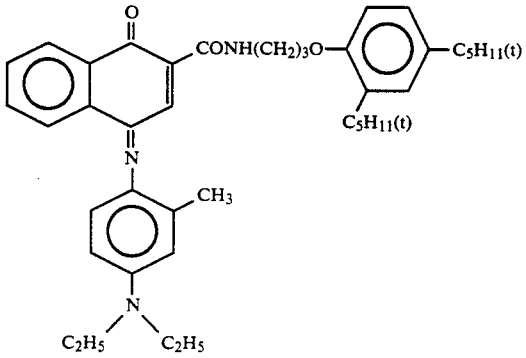
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_17SO_2NHCH_2CH_2CH_2OCH_2CH_2\overset{\oplus}{N}(CH_3)_3$
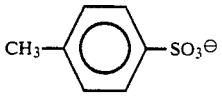
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
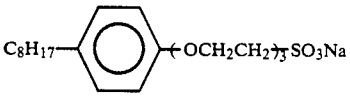
P-1
$\left(CH_2{-}CH(CONHC_4H_9(t))\right)_n$
M-1
$\left(CH_2{-}CH(COOC_4H_9)\right)_n$
F-1
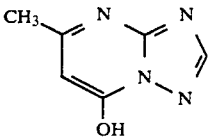

-continued

F-2

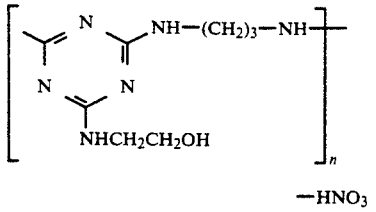

F-3

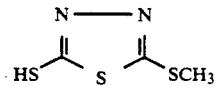

F-4

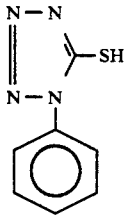

F-5

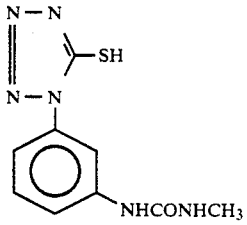

F-6

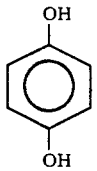

F-7

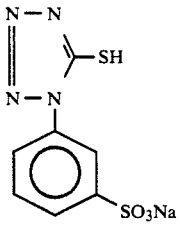

F-8

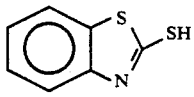

Preparation of Samples Nos. 602 to 607

Samples Nos. 602 to 607 were prepared in the same manner as in preparation of Sample No. 601, except that the yellow colloidal silver in the thirteenth layer was replaced by a dispersion of fine solid grains of a dye as indicated in Table 6 below (dye of the present invention or comparative dye). The amount of the dye in the thirteenth layer was 0.260 g/m$^2$ in every sample. The dispersion of fine grains of each dye was prepared in the same manner as that indicated in Example 5 for preparing the anti-halation layer (AH layer) (5-(b)).

Each of these samples was cut into strips, imagewise exposed and then processed at 38° C. in accordance with the process mentioned below. The density of each of the thus processed strips was measured.

The results obtained are shown in Table 6 below.

| Processing Steps | | | | |
|---|---|---|---|---|
| Step | Time | Temperature | Tank Capacity | Amount of Replenisher |
| Black-and-white development | 6 min. | 38° C. | 12 l | 2.2 ml/m$^2$ |
| First Rinsing | 2 min. | 38° C. | 4 l | 7.5 ml/m$^2$ |
| Reversal | 2 min. | 38° C. | 4 l | 1.1 ml/m$^2$ |
| Color | 6 min. | 38° C. | 12 l | 2.2 ml/m$^2$ |

-continued

| Processing Steps | | | | |
|---|---|---|---|---|
| Step | Time | Temperature | Tank Capacity | Amount of Replenisher |
| development | | | | |
| Bleaching | 3 min. | 38° C. | 6 l | 0.15 ml/m$^2$ |
| Fixation | 4 min. | 38° C. | 8 l | 2.2 ml/m$^2$ |
| Second Rinsing (1) | 2 min. | 38° C. | 4 l | — |
| Second Rinsing (2) | 2 min. | 38° C. | 4 l | 7.5 ml/m$^2$ |
| Stabilization | 2 min. | 38° C. | 4 l | 1.1 ml/m$^2$ |
| Third Rinsing | 1 min. | 38° C. | 4 l | 1.1 ml/m$^2$ |

(The overflow from the second rinsing step (2) was recirculated to the second rinsing step bath (1).)

Processing solutions used in the above-mentioned process had the following compositions.

| Black-and-white Developer: | Tank Solution | Replenisher |
|---|---|---|
| Tetrasodium Nitrilo-N,N,N-trimethylenephosphonate | 2.0 g | 2.0 g |
| Pentasodium Diethylenetriamine-pentaacetate | 3.0 g | 3.0 g |
| Potassium Sulfite | 30.0 g | 30.0 g |
| Potassium Hydroquinone-monosulfonate | 20.0 g | 20.0 g |
| Potassium Carbonate | 33.0 g | 33.0 g |
| 1-Phenyl-4-methyl-4-hydroxymethyl-3-pyrazolidone | 2.0 g | 2.0 g |
| Potassium Bromide | 2.5 g | 1.4 g |
| Potassium Thiocyanate | 1.2 g | 1.2 g |
| Potassium Iodide | 2.0 mg | 2.0 mg |
| Water to make | 1.0 liter | 1.0 liter |
| pH (25° C.) | 9.60 | 9.70 |

(pH was adjusted with hydrochloric acid or potassium hydroxide.)

Reversal Solution

Mother solution and replenisher were same.

| | |
|---|---|
| Pentasodium Nitrilo-N,N,N-trimethylene phosphonate | 3.0 g |
| Stannous Chloride Dihydrate | 1.0 g |
| p-Aminophenol | 0.1 g |
| Sodium Hydroxide | 8.0 g |
| Glacial Acetic Acid | 15.0 ml |
| Water to make | 1.0 liter |
| pH (25° C.) | 6.00 |

(pH was adjusted with hydrochloric acid or potassium hydroxide.)

| Color Developer: | Tank Solution | Replenisher |
|---|---|---|
| Pentasodium Nitrilo-N,N,N-trimethylenephosphonate | 2.0 g | 2.0 g |
| Pentasodium Diethylenetriaminepentaacetate | 2.0 g | 2.0 g |
| Sodium Sulfite | 7.0 g | 7.0 g |
| Tripotassium Phosphate 12-hydrate | 36.0 g | 36.0 g |
| Potassium Bromide | 1.0 g | — |
| Potassium Iodide | 90.0 mg | — |
| Sodium Hydroxide | 3.0 g | 3.0 g |
| Citrazinic Acid | 1.5 g | 1.5 g |
| N-ethyl (β-methanesulfonamidoethyl)-3-methyl-4-aminoaniline Sulfate | 10.5 g | 10.5 g |
| 3,6-Dithiaoctane-1,8-diol | 3.5 g | 3.5 g |
| Water to make | 1.0 liter | 1.0 liter |
| pH (25° C.) | 11.90 | 12.05 |

(pH was adjusted with hydrochloric acid or potassium hydroxide.)

| Bleaching Solution: | Tank Solution | Replenisher |
|---|---|---|
| 1,3-Diaminopropane-tetraacetic Acid | 2.8 g | 4.0 g |
| Ammonium 1,3-Diaminopropane-tetraacetato Ferrate Monohydrate | 138.0 g | 207.0 g |
| Ammonium Bromide | 80.0 g | 120.0 g |
| Ammonium Nitrate | 20.0 g | 30.0 g |
| Hydroxyacetic Acid | 50.0 g | 75.0 g |
| Acetic Acid | 50.0 g | 75.0 g |
| Water to make | 1.0 liter | 1.0 liter |
| pH (25° C.) | 3.40 | 2.80 |

(pH was adjusted with acetic acid or aqueous ammonia.)

Fixing Solution

Mother solution and replenisher were same.

| | |
|---|---|
| Disodium Ethylenediaminetetraacetate Dihydrate | 1.7 g |
| Sodium Benzaldehyde o-sulfonate | 20.0 g |
| Sodium Bisulfite | 15.0 g |
| Ammonium thiosulfate (700 g/liter) | 340.0 ml |
| Imidazole | 28.0 g |
| Water to make | 1.0 liter |
| pH (25° C.) | 4.00 |

(pH was adjusted with acetic acid or aqueous ammonia.)

Stabilizing Solution

Mother solution and replenisher were same.

| | |
|---|---|
| Disodium Ethylenediaminetetraacetate Dihydrate | 1.0 g |
| Sodium Carbonate | 6.0 g |
| Formalin (37%) | 5.0 ml |
| Water to make | 1.0 liter |
| pH (25° C.) | 10.00 |

(pH was adjusted with acetic acid or sodium hydroxide.)

Third Rinsing Solution

Mother solution and replenisher were same.

| | |
|---|---|
| Disodium Ethylenediaminetetraacetate Dihydrate | 0.2 g |
| Hydroxyethylidene-1,1-diphosphonic Acid | 0.05 g |
| Ammonium Acetate | 2.0 g |
| Sodium Dodecylbenzenesulfonate | 0.3 g |
| pH (25° C.) | 4.50 |

(pH was adjusted with acetic acid or aqueous hydroxide.)

TABLE 6

| Sample | Dye Added | Relative Sensitivity B | G | R | Maximum Density B | G | R |
|---|---|---|---|---|---|---|---|
| 601 (comparative sample) | Yellow colloidal silver | ±0 | ±0 | ±0 | ±0 | ±0 | ±0 |
| 602 (comparative sample) | 6-A*) | +0.02 | +0.06 | +0.01 | +0.19 | +0.18 | +0.04 |
| 603 (comparative sample) | 6-B*) | +0.02 | −**) | −**) | +0.20 | +0.10 | +0.01 |
| 604 (sample of the invention) | I-3 | +0.01 | +0.07 | +0.02 | +0.29 | +0.26 | +0.05 |
| 605 (sample of the invention) | I-6 | +0.01 | +0.07 | +0.02 | +0.26 | +0.25 | +0.08 |
| 606 (sample of the invention) | I-7 | +0.01 | +0.06 | +0.02 | +0.27 | +0.24 | +0.06 |
| 607 (sample of the invention) | I-12 | +0.00 | +0.06 | +0.02 | +0.26 | +0.24 | +0.11 |

(*) Compartive samples used were as follows:
Comparative Dye (6-A):

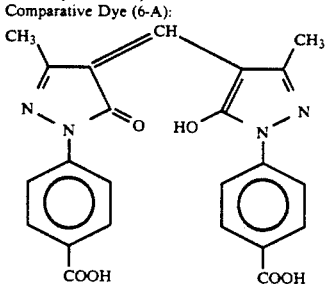

(Dye as described in JP-A-52-92716)
Comparative Dye (6-B):

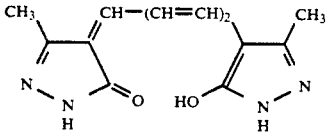

(Dye as described in JP-A-55-120030)
(**) Extremely lowered.

From the results in Table 6 above, it is noted that the samples of the present invention containing the particular dye as defined in the present invention gave a higher maximum density than the comparative samples containing a comparative dye while the relative sensitivity of the samples of the present invention was almost comparable to that of the comparative samples.

While the invention has been described in detail and with reference to specific embodiments thereof, it will be apparent to one skilled in the art that various changes and modifications can be made therein without departing from the spirit and scope thereof.

What is claimed is:

1. A silver halide photographic element having a hydrophilic colloid layer which contains a dispersion of fine solid grains of at least one dye of a general formula (I) having an average grain size of from 0.01 to 10 μm and in an amount of from 1 to 1000 mg per $m^2$ of the photographic element which is sufficient to give an optical density of from 0.05 to 3.5:

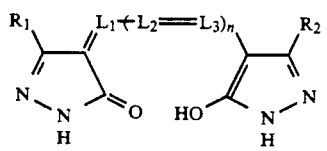

(I)

where $R_1$ and $R_2$ each represents an alkyl group, an aryl group, a cyano group or a group of $COOR_3$, $COR_3$, $CONR_4R_5$, $NR_4R_5$, $NR_4COR_3$, $NR_4CONR_4R_5$, $OR_3$, $SR_3$, $SOR_3$ or $SO_2R_3$; $R_3$ being an alkyl group or an aryl group, and $R_4$ and $R_5$ each being a hydrogen atom, an alkyl group or an aryl group, and $R_3$ and $R_4$ or $R_4$ and $R_5$ being optionally bonded to each other to form a 5-membered or 6-membered ring; $L_1$, $L_2$ and $L_3$ each represents a methine group; and n represents 0 or 1; provided that $R_1$, $R_2$, $L_1$, $L_2$ and $L_3$ must not have an ionizable proton-having group or a salt-thereof.

2. The silver halide photographic element as in claim 1, which has, in addition to the dispersion of fine solid grains of at least one dye of formula (I), a dispersion of fine solids grains of at least one dye of a general formula (II) in an amount of from 1 to 1000 mg per $m^2$ of the photographic element:

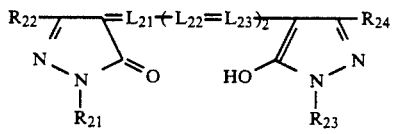

(II)

where $R_{21}$ and $R_{23}$ each represents a hydrogen atom, an alkyl group or an aryl group; $R_{22}$ and $R_{24}$ each represents an alkyl group, an aryl group, or a group of $OR_{26}$, $COOR_{26}$, $COR_{25}$, $SR_{26}$, $SOR_{25}$, $SO_2R_{25}$, $CONR_{26}R_{27}$, $NR_{26}COR_{25}$, $NR_{26}CONR_{26}R_{27}$ or $NR_{25}R_{26}$, or a cyano group; $R_{25}$ being an alkyl group or an aryl group, and $R_{26}$ and $R_{27}$ each being a hydrogen atom, an alkyl group or an aryl group, and $R_{25}$ and $R_{26}$ or $R_{26}$ and $R_{27}$ being optionally bonded to each other to form a 5-membered or 6-membered ring; and $L_{21}$, $L_{22}$ and $L_{23}$ each represents a methine group; provided that the dye has at least one aryl group having at least one substituent selected from the group consisting of a carboxylic acid group, a sulfonamide group and an arylsulfamoyl group except for the case where $R_{21}$ and $R_{23}$ are both hydrogen atoms.

3. The silver halide photographic element as in claim 2, which has the dyes of formulae (I) and (II) in the same hydrophilic colloid layer.

4. The silver halide photographic element as in claim 2, which has the dyes of formulae (I) and (II) in different hydrophilic colloid layers.

5. The silver halide photographic element as in claim 1, wherein the dye of formula (I) is used in an amount of from 1 to 800 mg per $m^2$ of the photographic material.

6. The silver halide photographic element as in claim 2, wherein the dye of formula (I) or (II) is used in an amount of from 1 to 800 mg per $m^2$ of the photographic material.

7. The silver halide photographic element as in claim 1, wherein the grain size of the fine solid grains of the dye of formula (I) is from 0.01 to 2 μm.

8. The silver halide photographic element as in claim 1, wherein the grain size of the fine solid grains of the dye of formula (I) is from 0.01 to 0.5 μm.

9. The silver halide photographic element as in claim 2, wherein the grain size of the fine solid grains of the dye of formula (I) or (II) is from 0.01 to 10 μm.

10. The silver halide photographic element as in claim 2, wherein the grain size of the fine solid grains of the dye of formula (I) or (II) is from 0.01 to 2 μm.

11. The silver halide photographic element as in claim 2, wherein the grain size of the fine solid grains of the dye of formula (I) or (II) is from 0.01 to 0.5 μm.

* * * * *